US010770279B2

(12) United States Patent
Giles et al.

(10) Patent No.: US 10,770,279 B2
(45) Date of Patent: Sep. 8, 2020

(54) ION TRANSFER APPARATUS

(71) Applicant: SHIMADZU CORPORATION, Kyoto (JP)

(72) Inventors: Roger Giles, Manchester (GB); Alina Giles, Manchester (GB)

(73) Assignee: SHIMADZU CORPORATION, Kyoto (JP)

( * ) Notice: Subject to any disclaimer, the term of this patent is extended or adjusted under 35 U.S.C. 154(b) by 3 days.

(21) Appl. No.: 15/778,799

(22) PCT Filed: Oct. 20, 2016

(86) PCT No.: PCT/EP2016/075275

§ 371 (c)(1),
(2) Date: May 24, 2018

(87) PCT Pub. No.: WO2017/089045

PCT Pub. Date: Jan. 6, 2017

(65) Prior Publication Data

US 2018/0350582 A1 Dec. 6, 2018

(30) Foreign Application Priority Data

Nov. 27, 2015 (GB) ..... 1521003.2
Nov. 27, 2015 (GB) ..... 1521004

(51) Int. Cl.
*H01J 49/24* (2006.01)
*H01J 49/04* (2006.01)
(Continued)

(52) U.S. Cl.
CPC ..... *H01J 49/24* (2013.01); *H01J 49/004* (2013.01); *H01J 49/0404* (2013.01);
(Continued)

(58) Field of Classification Search
CPC ..... H01J 49/24; H01J 49/004; H01J 49/0404; H01J 49/044; H01J 49/0445; H01J 49/066; H01J 49/067; H01J 49/107
See application file for complete search history.

(56) References Cited

U.S. PATENT DOCUMENTS 5,270,542 A 12/1993 McMurry et al.
5,572,035 A * 11/1996 Franzen ..... H01N 49/062 250/292
(Continued)

FOREIGN PATENT DOCUMENTS

GB 2 370 685 A 7/2002
GB 2489623 A 10/2012
(Continued)

OTHER PUBLICATIONS

Communication dated Jun. 29, 2016 from the Britain Intellectual Property Office in counterpart Application No. GB1521004.0.
(Continued)

*Primary Examiner* — Nicole M Ippolito
*Assistant Examiner* — Sean M Luck
(74) *Attorney, Agent, or Firm* — Sughrue Mion, PLLC

(57) ABSTRACT

An ion transfer apparatus for transferring ions from an ion source at an ion source pressure, which ion source pressure is greater than 500 mbar, along a path towards a mass analyser at a mass analyser pressure that is lower than the ion source pressure. The apparatus includes a plurality of pressure controlled chambers, wherein each pressure controlled chamber in the ion transfer apparatus includes an ion inlet opening for receiving ions from the ion source on the path and an ion outlet opening for outputting the ions on the path. The plurality of pressure controlled chambers are arranged in succession along the path from an initial pressure controlled chamber to a final pressure controlled chamber, wherein an ion outlet opening of each pressure con-
(Continued)

trolled chamber other than the final pressure controlled chamber is in flow communication with the ion inlet opening of a successive adjacent pressure controlled chamber. The ion transfer apparatus is configured to have, in use, at least one pair of adjacent pressure controlled chambers for which a ratio of pressure in an upstream pressure controlled chamber to pressure in a downstream pressure controlled chamber is set such that there is substantially subsonic gas flow in the downstream pressure controlled chamber.

18 Claims, 21 Drawing Sheets

(51) Int. Cl.
*H01J 49/06* (2006.01)
*H01J 49/10* (2006.01)
*H01J 49/00* (2006.01)

(52) U.S. Cl.
CPC ..... *H01J 49/044* (2013.01); *H01J 49/0445* (2013.01); *H01J 49/066* (2013.01); *H01J 49/067* (2013.01); *H01J 49/107* (2013.01)

(56) References Cited

U.S. PATENT DOCUMENTS 5,789,745 A * 8/1998 Martin ..... H01J 49/0018 250/281
6,107,628 A * 8/2000 Smith ..... H01J 49/066 250/292
6,943,347 B1 * 9/2005 Willoughby ..... H01J 49/0404 250/288
7,064,321 B2 * 6/2006 Franzen ..... H01J 49/066 250/281
7,838,826 B1 * 11/2010 Park ..... G01N 27/622 250/281
8,610,054 B2 * 12/2013 Giles ..... G01N 27/624 250/282
2002/0175278 A1 * 11/2002 Whitehouse ..... H01J 49/0095 250/281
2004/0217280 A1 * 11/2004 Schneider ..... H01J 49/044 250/288
2004/0262512 A1 12/2004 Tobita et al.
2005/0189486 A1 * 9/2005 Fuhrer ..... G01N 27/622 250/287
2006/0076485 A1 * 4/2006 Stoermer ..... H01J 49/065 250/290
2006/0108520 A1 5/2006 Park et al.
2007/0158543 A1 * 7/2007 Clowers ..... G01N 27/622 250/282
2009/0127455 A1 * 5/2009 Kim ..... H01J 49/066 250/288
2009/0321655 A1 12/2009 Makarov et al.
2010/0090101 A1 * 4/2010 Schultz ..... H01J 49/0418 250/282
2010/0213366 A1 * 8/2010 Fernandez De La Mora ..... G01N 27/624 250/282
2011/0036980 A1 2/2011 Lisa et al.
2011/0183431 A1 * 7/2011 Covey ..... G01N 27/624 436/173
2012/0261570 A1 * 10/2012 Shvartsburg ..... H01J 49/0018 250/287
2013/0140454 A1 * 6/2013 Loboda ..... H01J 49/067 250/288
2013/0161508 A1 * 6/2013 Sapargaliyev ..... H01J 49/408 250/282
2013/0175441 A1 * 7/2013 Zanon ..... H01J 49/066 250/288
2013/0187044 A1 * 7/2013 Ding ..... H01J 49/065 250/292
2013/0256525 A1 * 10/2013 Hill, Jr. ..... H01J 49/02 250/282
2013/0313336 A1 11/2013 Doak et al.
2014/0061457 A1 * 3/2014 Berdnikov ..... H01J 49/065 250/281
2014/0264007 A1 * 9/2014 Remes ..... H01J 49/0031 250/282
2015/0340218 A1 * 11/2015 Papanastasiou .... H01J 49/0404 250/289
2018/0233342 A1 * 8/2018 Boock ..... H01J 49/0031

FOREIGN PATENT DOCUMENTS

GB 2512640 A 10/2014
WO 2009/030048 A1 3/2009
WO 2012/150351 A1 11/2012
WO 2015/101821 A1 7/2015
WO 2015/181564 A1 12/2015

OTHER PUBLICATIONS

Communication dated Aug. 14, 2016 from the Britain Intellectual Property Office in counterpart Application No. GB1521003.2.
International Search Report dated Nov. 21, 2016, issued by the International Searching Authority in application No. PCT/EP2016/075275.

* cited by examiner

| chamber | JPR | pressures [Pa] | Gas removed within each chamber (mbar l/s) | Gas flow in jet (mbar l/s) at exit of each chamber | Mach Number at entrance to the nth chamber | Mach Number in the exit region of the nth chamber |
|---|---|---|---|---|---|---|
| 1 | 1.25 | 80000 | -2.9 | 458 | 0.58 | 0.45 |
| 3 | 1.27 | 63000 | -107 | 351 | 0.76 | 0.35 |
| 5 | 1.34 | 47000 | -90.5 | 260 | 0.76 | 0.35 |
| 7 | 1.34 | 35000 | -67.8 | 193 | 0.76 | 0.35 |
| 9 | 1.35 | 26000 | -48.9 | 144 | 0.76 | 0.35 |
| 11 | 1.37 | 19000 | -36.9 | 107 | 0.78 | 0.36 |
| 13 | 1.41 | 13500 | -29.8 | 77 | 0.79 | 0.37 |
| 15 | 1.44 | 9400 | -23.1 | 54.0 | 0.81 | 0.37 |
| 17 | 1.45 | 6500 | -16.8 | 37.2 | 0.82 | 0.38 |
| 19 | 1.44 | 4500 | -11.5 | 25.6 | 0.82 | 0.38 |
| 21 | 1.45 | 3100 | -8.14 | 17.5 | 0.83 | 0.38 |
| 23 | 1.43 | 2160 | -5.17 | 12.3 | 0.82 | 0.38 |
| 25 | 1.52 | 1420 | -4.19 | 8.14 | 0.84 | 0.4 |
| 27 | 1.47 | 965 | -2.91 | 5.23 | 0.835 | 0.25 |
| 29 | 1.72 | 560 | -2.04 | 3.19 | 0.95 | 0.29 |
| | 2.25 | 250 | | | | |

Figure 3

| Chamber ref | JPR | P(Pa) | Entrance gas velocity | Exit gas velocity |
|---|---|---|---|---|
| 1225 | 1.52 | 1420 | 300 | 250 |
| 1227 | 1.47 | 965 | 310 | 250 |
| 1229 | 1.73 | 560 | 340 | 260 |
| 1231 | 2.25 | 250 | 330 | 190 |
| 1233 | 4.17 | 60 | 300 | 180 |
| 1235 | 5 | 12 | 400 | 10 |
| 1237 | 12 | 1 | 300 | 0 |

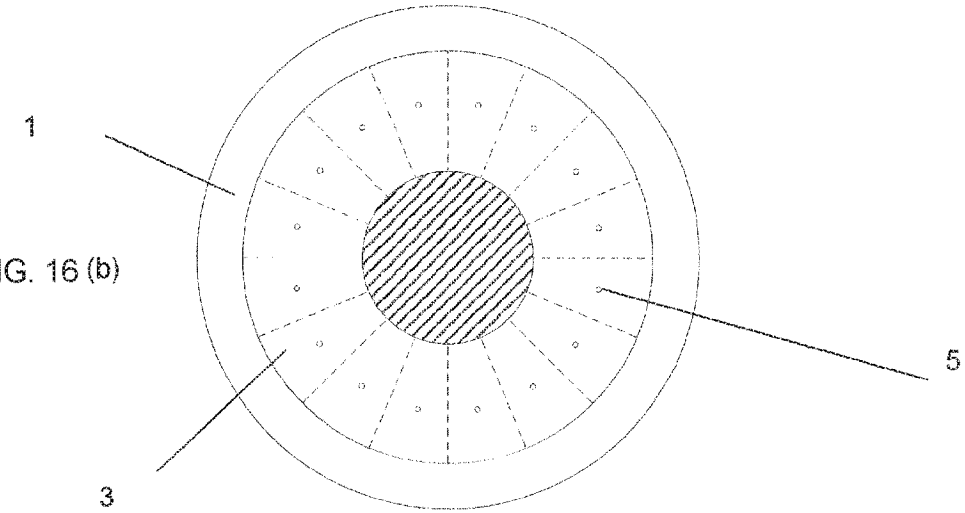
FIG. 16 (b)
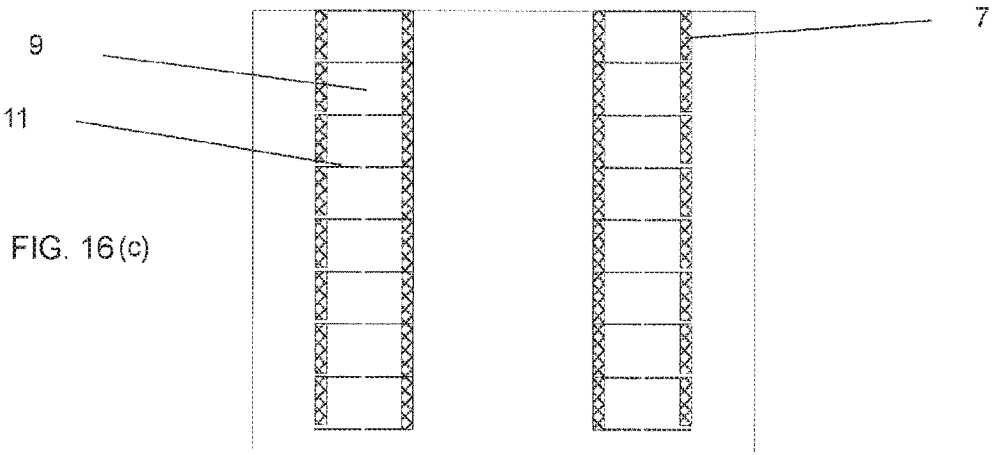
FIG. 16 (c)
| aperture *h* radius (mm) | Number of apertures | Device length (mm) |
|---|---|---|
| 1.00 | 1 | 900.0 |
| 0.50 | 4 | 450.0 |
| 0.33 | 9 | 300.0 |
| 0.25 | 16 | 225.0 |
| 0.20 | 25 | 180.0 |
| 0.17 | 36 | 150.0 |
| 0.14 | 49 | 128.6 |
| 0.13 | 64 | 112.5 |
FIG. 16 (a)

ION TRANSFER APPARATUS

CROSS REFERENCE TO RELATED APPLICATIONS

This application is a National Stage of International Application No. PCT/EP2016/075275 filed Oct. 20, 2016, claiming priority based on British Patent Application No. 1521003.2 filed Nov. 27, 2015 and British Patent Application No. 1521004.0 filed Nov. 27, 2015.

FIELD OF THE INVENTION

This invention relates to an ion transfer apparatus.

BACKGROUND

Atmospheric pressure ionization has evolved into an indispensable analytical tool in mass spectrometry and applications in life sciences with a significant impact in areas spanning from drug discovery to protein structure and function as well as the emerging field of systems biology applied to biomedical scientific research. The advent of atmospheric pressure ionization and particularly electrospray enabled the analysis of intact macromolecular ions under native conditions which offers a wealth of information to many different disciplines of science. The generation of intact ionic species is accomplished at or near atmospheric pressure whereas the determination of molecular mass is accomplished at high vacuum. Therefore transfer efficiency of ions generated at high pressure toward consecutive regions of the mass spectrometer operated at reduced pressure is a critical parameter, which determines instrument performance in terms of sensitivity.

Electrospray ionization ("ESI") is the prevailing method for generation of gas phase ions where ions in solution are sprayed typically under atmospheric pressure and in the presence of a strong electric field. Charged droplets released from the ESI emitter tip undergo a recurring process of evaporation and fission ultimately releasing ions sampled by an inlet capillary or other types of inlet apertures. The inlet aperture forms the interface of the instrument and represents a physical barrier between the high pressure ionization region and the fore vacuum region normally operated at 1 mbar background pressure. The size of the inlet aperture or capillary employed to admit ions in the fore vacuum is typically limited to ~0.5 mm in diameter to establish the pressure differential preferred for the existing ion optical components to be operable and transport ions to subsequent lower pressure vacuum regions efficiently. Consequently, sampling efficiency of the spray containing charged droplets and bare ions using standard interface designs is limited to <1% and has a profound effect on instrument sensitivity.

The design of a high transmission interface for efficient transportation of ions from atmospheric pressure into the fore vacuum region of a mass spectrometer has grown into a challenging problem. One approach involves increasing pumping speed to accommodate relatively small increments in the size of the inlet aperture. Although increasing the inlet aperture appears a rather straight forward solution the inefficient heat transfer and incomplete desolvation of the electrospray droplets are not easily addressed. Furthermore, the cost related to the increased pumping speed becomes considerable. Efforts for improved ion transfer efficiency are also directed toward the development of novel ion optical devices operable at elevated pressure. The ion funnel has been operated successfully at pressures as high as 30 mbar, nevertheless increments in the size of the inlet aperture remain marginal. In yet another design of an interface a multi-inlet capillary configuration is implemented in an effort to sample a larger area of the electrospray plume. Using this type of a novel multi-inlet system enhanced transfer efficiency is claimed, however, the ion losses at the interface are still severe since the reduction in pressure from atmospheric to near or below 10 mbar requires the cross sectional area of the inlet to be kept small. Reducing pressure by approximately two orders of magnitude in a single step is inevitably associated with severe ion losses due to the narrow aperture or other types of multi-inlet system configurations employed. Indeed, these approaches do not address the underlying loss mechanisms arising from diffusion losses, space charge losses, and high gas velocity at the exit of the capillary/capillaries or skimmer. This latter problem can result in a high value for the turbulent velocity ratio ("TVR") and the high gas speed prevents effective focusing via an electrical field.

In an entirely different approach a multi-chamber configuration has been disclosed to operate using enlarged apertures and where pressure is reduced progressively from the fore vacuum pressure of ~5 mbar to regions of lower pressure. Over this pressure range ions can be guided by RF electrical fields. Whilst use of a series of vacuum regions to reduce pressure progressively may enhance ion transfer efficiency to the high vacuum region, it does not address the problem of the majority of the ions being lost at the interface where a single inlet aperture is employed to sustain a large drop in pressure which is typically from 1 bar down to 5 mbar.

U.S. Pat. No. 6,943,347 discloses a tube for accepting gas-phase ions and particles contained in a gas by allowing substantially all the gas-phase ions and gas from an ion source at or greater than atmospheric pressure to flow into the tube and be transferred to a lower pressure region. Transport and motion of the ions through the tube is determined by a combination of viscous forces exerted on the ions by the flowing gas molecules and electrostatic forces causing the motion of the ions through the tube and away from the walls of the tube. More specifically, the tube is made up of stratified elements, wherein DC potentials are applied to the elements so that the DC voltage on any element determines the electric potential experience by the ions as they pass through the tube. A precise electrical gradient is maintained along the length of the stratified tube to insure the transport of the ions.

WO2008055667 discloses a method of transporting gas and entrained ions between higher and lower pressure regions of a mass spectrometer comprises providing an ion transfer conduit 60 between the higher and lower pressure regions. The ion transfer conduit 60 includes an electrode assembly 300 which defines an ion transfer channel. The electrode assembly 300 has a first set of ring electrodes 305 of a first width D1, and a second set of ring electrodes of a second width D2 (=D1) and interleaved with the first ring electrodes 305. A DC voltage of magnitude V1 and a first polarity is supplied to the first ring electrodes 205 and a DC voltage of magnitude V2 which may be less than or equal to the magnitude of V1 but with an opposed polarity is applied to the second ring electrodes 310. The pressure of the ion transfer conduit 60 is controlled so as to maintain viscous flow of gas and ions within the ion transfer channel.

WO2009/030048 discloses a mass spectrometer including a plurality of guide stages for guiding ions between an ion source and an ion detector along a guide axis. Each of the guide stages is contained within one of a plurality of adjacent chambers. Pressure in each of the plurality of chambers is reduced downstream along the guide axis to guide ions along the axis. Each guide stage may further include a plurality of guide rods for producing a containment filed for containing ions about the guide axis, as they are guided to the detector.

U.S. Pat. No. 7,064,321 (also published as US2005/006579) discloses an ion funnel that screens ions from a gas stream flowing into a differential pump stage of a mass spectrometer, and transfers them to a subsequent differential pump stage. The ion funnel uses apertured diaphragms between which gas escapes easily. Holders for the apertured diaphragms are also provided that offer little resistance to the escaping gas while, at the same time, serving to feed the RF and DC voltages U.S. Pat. No. 8,610,054 discloses an ion analysis apparatus for conducting differential ion mobility analysis and mass analysis. In embodiments, the apparatus comprises a differential ion mobility device in a vacuum enclosure of a mass spectrometer, located prior to the mass analyser, wherein the pumping system of the apparatus is configured to provide an operating pressure of 0.005 kPa to 40 kPa for the differential ion mobility device, and wherein the apparatus includes a digital asymmetric waveform generator that provides a waveform of frequency of 50 kHz to 25 MHz. Examples demonstrate excellent resolving power and ion transmission. The ion mobility device can be a multipole, for example a 12-pole and radial ion focusing can be achieved by applying a quadrupole field to the device in addition to a dipole field.

US2009/127455 discloses ion guides for use in mass spectrometry and the analysis of chemical samples. The disclosure includes a method and apparatus for transporting ions from a first pressure region in a mass spectrometer to a second pressure region therein. More specifically, the disclosure provides a segmented ion funnel for more efficient use in mass spectrometry (particularly with ionization sources) to transport ions from the first pressure region to the second pressure region.

"A multicapillary inlet jet disruption electrodynamic ion funnel interface for improved sensitivity using atmospheric pressure ion sources", Kim T, Tang K, Udseth H R, Smith R D/Anal Chem. 2001 Sep. 1; 73(17):4162-70 discloses a multicapillary inlet jet disruption electrodynamic ion funnel interface for improved sensitivity using atmospheric pressure ion sources.

PCT/GB2015/051569 (currently unpublished, but relevant extracts from which are included in the present disclosure as an Annex) discloses an ion transfer apparatus comprising a plurality of pressure control chambers. This ion transfer apparatus was designed to provide an improved interface design capable of transferring ions into the fore vacuum region with greater efficiency while maintaining effective desolvation of charged droplets.

The present invention has been devised in light of the above considerations.

In some embodiments, the present invention may provide improvements to the ion transfer apparatus described in PCT/GB2015/051569 (currently unpublished, but relevant extracts from which are included in the present disclosure as an Annex).

SUMMARY OF THE INVENTION

A first aspect of the invention may provide:

An ion transfer apparatus for transferring ions from an ion source at an ion source pressure, which ion source pressure is greater than 500 mbar, along a path towards a mass analyser at a mass analyser pressure that is lower than the ion source pressure, the apparatus including:

a plurality of pressure controlled chambers, wherein each pressure controlled chamber in the ion transfer apparatus includes an ion inlet opening for receiving ions from the ion source on the path and an ion outlet opening for outputting the ions on the path;

wherein the plurality of pressure controlled chambers are arranged in succession along the path from an initial pressure controlled chamber to a final pressure controlled chamber, wherein an ion outlet opening of each pressure controlled chamber other than the final pressure controlled chamber is in flow communication with the ion inlet opening of a successive adjacent pressure controlled chamber;

wherein the ion transfer apparatus is configured to have, in use, at least one pair of adjacent pressure controlled chambers for which a ratio of pressure in an upstream pressure controlled chamber to pressure in a downstream pressure controlled chamber (in the/each pair) is set such that there is substantially subsonic gas flow in the downstream pressure controlled chamber (in the/each pair).

In this way, it has been found that gas can be removed from the upstream pressure controlled chamber (in the/each pair) in a manner that permits the focusing of ions against the gas flow for ions having a wide range of mobility values in the downstream pressure controlled chamber. As discussed in more detail below, this can lead to advantages such as increased sensitivity and dynamic range of subsequent mass spectrometry analysis (highest to lowest ratio of sample ions concentration that may be submitted without saturation effects).

Note that the ratio of pressure in the upstream pressure controlled chamber to pressure in the downstream pressure controlled chamber (in the/each pair) will predominantly affect the gas flow in the downstream pressure controlled chamber, hence the reference to substantially subsonic gas flow in the downstream pressure controlled chamber in the above definition.

For the purposes of this disclosure, the term "subsonic gas flow" may be understood as describing a gas flow moving at a speed that is lower than the speed of sound.

A skilled person would appreciate that a substantially subsonic gas flow in a downstream pressure controlled chamber may contain a very small localised region around an inlet opening in which the gas flow has a speed that is at or exceeds the speed of sound. Such a region (if present) would typically have dimensions comparable to a width of the inlet opening. The presence or absence of a substantially subsonic gas flow in a downstream chamber can be inferred from the pressure ratio between an adjacent upstream chamber and the downstream chamber and/or simulation (suitable pressure ratios for achieving subsonic gas flow in a downstream chamber are defined below).

For the purposes of this disclosure, an "upstream" pressure controlled chamber in a pair of adjacent pressure controlled chambers is a pressure controlled chamber in the pair that is at a higher pressure than the other pressure controlled chamber in the pair. The "downstream" pressure controlled chamber in the pair is then the other pressure controlled chamber in the pair (that is at a lower pressure than the "upstream" pressure controlled chamber).

The initial pressure controlled chamber may be adjacent to and configured to receive ions from the ion source, e.g. through the ion inlet opening of the initial pressure controlled chamber.

The final pressure controlled chamber may be configured to transfer ions to the mass analyser, e.g. directly, or e.g. indirectly via one or more intervening components (e.g. a collision cell, a cooling cell).

The ion source pressure may be atmospheric pressure. The ion source may be an ESI ion source.

The mass analyser pressure may be $1\times10^{-2}$ mbar or less.

For the/each pair of adjacent pressure controlled chambers (in the at least one pair of adjacent pressure controlled chambers for which a ratio of pressure in an upstream pressure controlled chamber to pressure in a downstream pressure controlled chamber is set such that there is substantially subsonic gas flow in the downstream pressure controlled chamber), the ratio of pressure in the upstream pressure controlled chamber to pressure in the downstream pressure controlled chamber (which ratio may be referred to as the jet pressure ratio, or "JPR") may be 2 or less, may be 1.8 or less, may be 1.6 or less, may be 1.4 or less. The lower this ratio, the slower the movement of gas in the downstream pressure controlled chamber in the/each pair of adjacent pressure controlled chambers, and hence the easier it is to focus ions (e.g. electrostatically) against the gas flow in the downstream pressure controlled chamber.

A ratio of 1.8 or less is particularly preferred (in the at least one pair of adjacent pressure controlled chambers for which a ratio of pressure in an upstream pressure controlled chamber to pressure in a downstream pressure controlled chamber is set such that there is substantially subsonic gas flow in the downstream pressure controlled chamber), as this has been found to provide substantially subsonic gas flow in the downstream pressure controlled chamber, see e.g. FIG. 5.

A ratio of more than 1 is of course needed to provide gas flow from the upstream pressure controlled chamber to the downstream pressure controlled chamber in the/each pair of adjacent pressure controlled chambers. A ratio of 1.1 or more, or 1.2 or more may help to provide an ion transfer apparatus having a smaller number of pressure controlled chambers.

The ion transfer apparatus may include one or more gas pumps configured to pump gas out from pressure controlled chambers in the ion transfer apparatus such that, in use, the ion transfer apparatus has at least one pair of adjacent pressure controlled chambers (preferably a plurality of pairs of adjacent pressure controlled chambers) for which a predetermined ratio of pressure in an upstream pressure controlled chamber to pressure in a downstream pressure controlled chamber (in the/each pair) is set. As would be appreciated by a skilled person, pressure controlled chambers may be independently pumped using a respective pump configured to pump gas out from each chamber, or one or more pumps may each be configured to pump gas out from multiple chambers. Some possible pumping arrangements are set out in the enclosed Annex.

The ion transfer apparatus may include 5 or more pressure controlled chambers, more preferably 8 or more pressure controlled chambers, more preferably 10 or more pressure controlled chambers. The number of pressure controlled chambers could be 20, 45 or even higher, depending on application requirements.

Preferably, the ion transfer apparatus is configured to have, in use, a plurality of pairs of adjacent pressure controlled chambers for which a ratio of pressure in an upstream pressure controlled chamber to pressure in a downstream pressure controlled chamber (in each pair) is set such that there is substantially subsonic gas flow in the downstream pressure controlled chamber (in each pair).

The number of pairs of adjacent pressure controlled chambers for which an above-mentioned pressure ratio condition is met (e.g. for which a ratio of pressure in an upstream pressure controlled chamber to pressure in a downstream pressure controlled chamber is set such that there is substantially subsonic gas flow in the downstream pressure controlled chamber) may be the majority of pairs of adjacent pressure controlled chambers in the ion transfer apparatus.

However, the number of pairs of adjacent pressure controlled chambers for which an above-mentioned pressure ratio condition is met need not be all pairs of adjacent pressure controlled chambers in the ion transfer apparatus, since downstream pressure controlled chambers in which the pressure is very low (e.g. less than 1000 Pa, e.g. less than 500 Pa) may still be capable of providing effective focusing of ions against the gas flow due to the low pressure present in such chambers.

In some embodiments, all pairs of adjacent pressure controlled chambers in the ion transfer apparatus for which the downstream pressure controlled chamber is at a pressure above a threshold pressure, meet an above-mentioned pressure ratio condition. This threshold may be 10000 Pa or more, more preferably 1000 Pa or more, more preferably 500 Pa or more.

The number of pairs of adjacent pressure controlled chambers for which an above-mentioned pressure ratio condition is met may, for example, be 5 or more, 10 or more, or 20 or more.

Preferably, each pressure controlled chamber in the ion transfer apparatus includes one or more focusing electrodes configured to produce an electric field that acts to focus ions towards the path (e.g. in a focusing region of the pressure controlled chamber). In this way, the focusing electrodes can keep ions on the path whilst gas is removed from the pressure controlled chambers.

Preferably, a subset (or all) of the pressure controlled chambers each include one or more DC focusing electrodes configured to receive one or more DC voltages so as to produce an electric field that acts to focus ions towards the path. A DC voltage may be understood as a non-alternating voltage (a voltage that does not alternate in time).

DC focusing electrodes have been found to be useful for pressure controlled chambers having a high pressure. The subset of the pressure controlled chambers that each include one or more DC focusing electrodes may therefore include those pressure controlled chambers having a pressure exceeding a threshold value. The threshold value may be 2000 Pa or higher, for example (e.g. in the region of 4000 Pa).

Preferably, a subset of the pressure controlled chambers each include one or more RF focusing electrodes, each RF focusing electrode being configured to receive an RF voltage so as to produce an electric field that acts to focus ions towards the path. An RF voltage may be understood as an alternating voltage that oscillates at a radio frequency.

Each RF focusing electrode may be included in an RF focusing device as described below.

RF focusing electrodes have been found to be useful for pressure controlled chambers having a low pressure. The subset of the pressure controlled chambers that each include one or more RF focusing electrodes may therefore include those pressure controlled chambers having a pressure below a threshold value. The threshold value may be 10000 Pa or lower (e.g. in the region of 4000 Pa).

At least one (preferably a majority of, preferably each) pressure controlled chamber in the ion transfer apparatus in which DC focusing is employed, may include one or more ion defocusing regions in which ions are not focused towards the path. This allows the ion transfer apparatus to be configured with zero electric potential difference between adjacent chamber walls, see e.g. FIG. 17.

The location of the/each ion defocusing region may depend on the configuration of electrodes and voltages used.

The ion outlet opening of each pressure controlled chamber may be formed by an aperture in a tapering (e.g. conical shaped) element in a wall of the chamber. The tapering element may be oriented to increase in radius along the path.

The ion transfer apparatus may be for transferring ions from the ion source at the ion source pressure along a plurality of paths towards the mass analyser that is at the mass analyser pressure, wherein each pressure controlled chamber comprises a respective ion inlet opening for receiving ions from the ion source on each path and a respective ion outlet opening for outputting ions on each path. In this case, the ion transfer apparatus may be referred to as a "multi-channel" device.

The plurality of ion outlet openings of each pressure controlled chamber may be arranged along a circumferential (e.g. circular, oval, square or other multi-sided shape) path, since this may help reduce the impact of gas flow moving radially away from one ion outlet opening from disrupting the gas flow moving radially away from other ion outlet opening(s).

The ion transfer apparatus may include a first pressure controlled chamber at a first pressure, which first pressure is lower than 10000 Pa, and an adjacent second pressure controlled chamber at a second pressure that is lower than the first pressure, wherein the ion outlet opening of the first pressure controlled chamber is in flow communication with the ion inlet opening of a the second pressure controlled chamber.

The ion transfer apparatus may include an RF focusing device configured to focus ions towards the path, the RF focusing device including a plurality of RF focusing electrodes, wherein each RF focusing electrode of the RF focusing device is configured to receive an RF voltage so as to produce an electric field that acts to focus ions towards the path, wherein each RF focusing electrode of the RF focusing device has a shape that extends circumferentially around the path.

The first and second pressure controlled chambers may include RF focusing electrodes of the RF focusing device.

If the ion source pressure is atmospheric pressure, then the first pressure controlled chamber and the second pressure controlled chamber may be included in a subset of the pressure controlled chambers that have a pressure below a threshold value. The threshold value may be 10000 Pa or lower (e.g. in the region of 4000 Pa).

If the ion source pressure is atmospheric pressure, then the first and second pressure controlled chambers may be located nearer to the mass analyser than to the ion source.

Preferably, each RF focusing electrode of the RF focusing device has a thickness in the direction of the path and a thickness in a direction radial to the path that is less than a distance separating the RF focusing electrode from an adjacent RF focusing electrode of the RF focusing device.

By having such thicknesses, the RF focusing electrodes in the RF focusing device are able to focus ions against gas flow caused by the difference in pressure between the first and second pressure controlled chambers, whilst being adequately "transparent" to the gas flow.

As explained in more detail below, RF focusing electrodes have been found to be useful for pressure controlled chambers at a pressure that is lower than 10000 Pa.

Preferably, for each RF focusing electrode of the RF focusing device, the thickness of the RF focusing electrode in the direction of the path and the thickness of the RF focusing electrode in a direction radial to the path is less than half (more preferably less than a quarter) of a distance separating the RF focusing electrode from an adjacent RF focusing electrode of the RF focusing device.

Preferably, for each RF focusing electrode of the RF focusing device, the RF focusing electrode is separated from an adjacent RF focusing electrode of the focusing device by a distance that is between 3 and 7 times (more preferably between 3 times and 6 times) the thickness of the RF focusing electrode in the direction of the path.

For each RF focusing electrode, the RF focusing electrode may be separated from an adjacent RF focusing electrode of the RF focusing device by a distance that is between 0.5 mm and 3 mm (although smaller dimensions may be appropriate, e.g. in a multi-channel device).

Preferably, for each RF focusing electrode of the RF focusing device, the thickness of the RF focusing electrode in a direction radial to the path is between 0.5 and 1.5 times the thickness of the RF focusing electrode in the direction of the path.

For each RF focusing electrode, the thickness of the RF focusing electrode in the direction of the path may, for example, be 0.1 mm to 0.4 mm.

For each RF focusing electrode, the thickness of the RF focusing electrode in a direction radial to the path may, for example, be 0.1 mm to 0.4 mm.

Preferably, each RF focusing electrode of the RF focusing device has a shape that extends circumferentially around the path to form an aperture, wherein the aperture has an internal width (i.e. distance from one inwardly facing surface of the focusing electrode to another inwardly facing surface of the focusing electrode).

The internal width of an aperture of each RF focusing electrode (at its maximum extent) may be set to be large enough so that the RF focusing electrode can focus ions in the gas flow in the chamber in which the RF focusing electrode is located. This could be achieved, for example, by setting the internal width of the aperture to be the same as or larger than the width of the inlet opening of the chamber in which the RF focusing electrode is located.

Preferably, for each RF focusing electrode of the RF focusing device, the internal width of an aperture in the RF focusing electrode at its maximum extent is between 1.5 and 10 times a distance separating the RF focusing electrode from an adjacent RF focusing electrode of the RF focusing device.

Preferably, for each RF focusing electrode of the RF focusing device, an aperture of the RF focusing electrode has an internal width that (e.g. at its maximum extent) is dependent on the position of the RF focusing electrode along the path, preferably such that the internal widths of the RF focusing electrodes reduce progressively with position along at least a portion of the path (or the whole path).

For each RF focusing electrode, an aperture of the RF focusing electrode may for example have an internal width that at its maximum extent is between 2 mm and 5 mm.

Preferably, for each RF focusing electrode of the RF focusing device, the RF focusing electrode has a circular (ring) shape that extends circumferentially around the path.

However, it is also possible for each RF focusing electrode of the RF focusing device to have another shape that extends circumferentially around the path, which shape may for example be an oval or other curved shape, or indeed a square or other multi-sided shape. Thus, for the avoidance of any doubt, the term "circumferentially" should not be construed as requiring the electrodes to have a circular shape.

Preferably, for each RF focusing electrode of the RF focusing device, the RF focusing electrode is part of a (respective) metal sheet, e.g. a chemically etched metal sheet.

Each metal sheet may include an outer support structure connected to the RF focusing electrode that is part of the metal sheet via at least one supporting limb.

For each metal sheet, the/each supporting limb connected to the RF focusing electrode that is part of the metal sheet preferably has a thickness in a direction circumferential to the path that is no more than 3 times (more preferably no more than 2 times) the thickness of the RF focusing electrode in the direction of the path.

For each metal sheet, a distance from the outer support structure to the RF focusing electrode that is part of the metal sheet is, at its minimum extent, preferably greater than an internal width of an aperture of the RF focusing electrode at its maximum extent. This is useful to provide space for gas flow out of the RF focusing electrodes in the RF focusing device.

Each RF focusing electrode of the RF focusing device may be configured to receive an RF voltage that is phase shifted with respect to an RF voltage received by an adjacent RF focusing electrode in the RF focusing device (the adjacent RF focusing electrode may be within the same pressure controlled chamber). For example, one or more pairs of adjacent RF focusing electrodes in the focusing device may be configured to receive RF voltages that are phase shifted by 180° with respect to each other.

The ion transfer device may include a wall separating the first chamber from the second chamber, wherein the wall includes the ion outlet opening of the first pressure controlled chamber. The wall or a portion of the wall that includes the ion outlet opening may be used as an RF focusing electrode of the RF focusing device, wherein the wall or portion of the wall is configured to receive an RF voltage so as to produce an electric field that acts to focus ions towards the path.

The ion outlet opening of the first pressure controlled chamber may have an internal width that (at its maximum extent) is the same as or comparable to (e.g. within 10% of) the internal width (at its maximum extent) of at least one adjacent RF focusing electrode in the RF focusing device.

If the second chamber has a pressure of more than 1000 Pa, the ratio of the pressure in the first chamber to the pressure in the second chamber is preferably less than 2, more preferably less than 1.8.

If the second chamber has a pressure of less than 1000 Pa, the ratio of the pressure in the first chamber to the pressure in the second chamber is preferably less than 5 (more preferably less than 3).

The path in the first pressure controlled chamber may be inclined relative to the path in the second pressure controlled chamber.

Preferably, the ion transfer apparatus includes more than two pressure controlled chambers (i.e. not just the first and second pressure controlled chamber). The ion transfer apparatus may include 5 or more pressure controlled chambers, more preferably 8 or more pressure controlled chambers, more preferably 10 or more pressure controlled chambers. The number of pressure controlled chambers could be 20, 45 or even higher, depending on application requirements.

The ion transfer device may include more than two (e.g. 5 or more) pressure controlled chambers that each include RF focusing electrodes of the RF focusing device.

For the avoidance of any doubt, the ion transfer device may include one or more pressure controlled chambers that do not include RF focusing electrodes of the RF focusing device.

Any of the feature or any combination of features described herein in relation to the first and second pressure controlled chamber may apply to each adjacent pair of pressure controlled chambers in which both chambers include RF focusing electrodes of the RF focusing device, Each pressure controlled chamber that includes RF focusing electrodes of the RF focusing device may be at a pressure that is lower than 10000 Pa.

A second aspect of the invention may provide a mass spectrometer including an ion transfer apparatus according to the first aspect of the invention.

The mass spectrometer may include an ion source configured to operate at an ion source pressure. The ion source pressure may be at atmospheric pressure. The ion source may be an electrospray ionisation ("ESI") ion source.

The mass spectrometer may include a mass analyser configured to operate at a mass analyser pressure. The mass analyser pressure may be $1\times10^{-2}$ mbar or less.

The ion transfer apparatus may be configured to transfer ions from the ion source towards the mass analyser along the path.

A third aspect of the invention may provide a method of operating an ion transfer apparatus according to the first aspect of the invention or a method of operating a mass spectrometer according to the second aspect of the invention.

The method may include any optional feature described above in connection with the first/second aspect of the invention, or any method step corresponding to any such feature.

A fourth aspect of the invention may provide a method of making an ion transfer apparatus according to the first aspect of the invention or a mass spectrometer according to the second aspect of the invention.

The method of making may include forming each RF electrode of the RF focusing device (if present) from a metal sheet, e.g. by chemical etching.

The invention also includes any combination of the aspects and preferred features described except where such a combination is clearly impermissible or expressly avoided.

References to "pressure" made herein, may be references to static pressure unless otherwise stated, as would be appreciated by a skilled person.

BRIEF DESCRIPTION OF THE DRAWINGS

Examples of these proposals are discussed below, with reference to the accompanying drawings in which:

FIG. 3 shows a table with the parameters used to calculate the data of FIG. 4(*a*) and FIG. 4(*b*).

FIG. 7(*b*) shows a schematic diagram of a pressure-controlled chamber with contour lines depicting regions of high negative and positive radial gas flow velocity near the apertures.

FIG. 12(*b*) shows a three-dimensional illustration of a focusing device (ion guides) in a pressure-controlled chamber.

FIG. 16(*a*) shows a table which gives the required number of apertures and length of the interface for a given aperture radius, assuming a gas acceptance flow rate of 460 mbar·l/s.

FIG. 16(*b*) shows a cross-sectional view as viewed from the front of an interface with sixteen apertures in each stage of the interface.

FIG. 16(*c*) shows a cross-sectional view as viewed from the side of an interface with sixteen apertures in each stage of the interface.

FIGS. 17(*b*)-(*d*) show plots of possible accelerating voltage profiles which can be applied to the electrodes in a pressure-controlled chamber.

DETAILED DESCRIPTION

Figure 1:
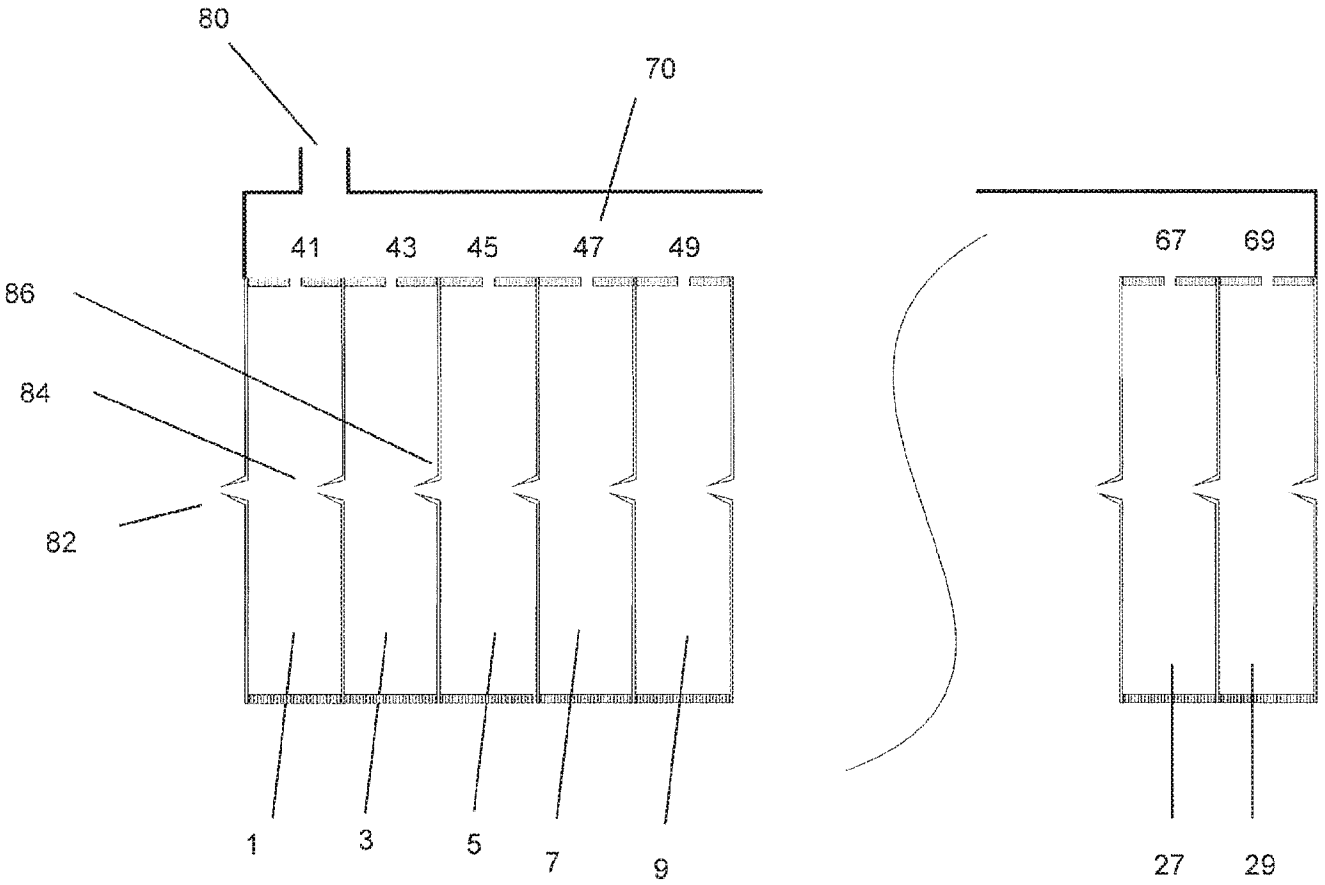
FIG. 1 shows a schematic diagram of an interface between a region at atmospheric pressure and one at low pressure comprising a plurality of chambers connected in series via sets of apertures, to provide a flow of gas from one chamber the next.

In general, the following discussion describes examples of our proposals that relate generally to mass spectrometry and apparatuses and methods for use in mass spectrometry. In particular, though not exclusively, the examples relate to the transmission of gaseous ionic species generated in a region of relatively high or higher pressure (e.g. at or near atmospheric pressure) into a relatively lower or low pressure region.

The term "ion transfer device" and "interface" may be used interchangeably herein.

In the examples discussed below, an ion transfer apparatus has a plurality of pressure controlled chambers, these chambers being operated with imposed fixed pressure ratios to maintain subsonic gas flow. There may be imposed decelerating and accelerating electric fields within a high gas pressure portion, and a gas transparent ring guide in a lower gas pressure portion having imposed RF focusing fields. The ion transfer apparatus may be implemented as a single channel or multiple channel device.

Beneficial effects of the ion transfer apparatus may include:

- An interface capable of accepting a higher gas input from an atmospheric pressure region.
- A higher proportion of ions may be carried with the high pressure gas flow compared to prior art devices.
- A higher ion current may be transported compared with prior art devices.
- A higher sensitivity and higher dynamic range may be achieved compared with prior art liquid chromatography-mass spectrometry ("LCMS") devices.

In the examples discussed below, a subsonic gas flow is maintained through the interface by minimising the gas jet pressure ratio between adjacent chambers. This allows ions entrained within the gas jet to remain within a gas jet. Means to focus ions against the expanding gas jet are provided, thereby providing a method of concentrating the ion flow with respect to the gas flow. They are combinations of static and dynamic electric fields applied in accordance with the features of the gas flow.

A starting point for the examples discussed below was the intention to seek improvements to the transport of gaseous ions into a first vacuum region from an atmospheric pressure region. The transfer efficiency of ions is very low in all existing devices, particularly for LCMS applications. The present inventors undertook research by experiment and by the development of simulation tools. These simulations have led to improved understanding of the mechanisms of ions loses in prior art devices and an improved understanding of the influence ion motion in high pressure gas flows. The present inventors' understanding before the present invention was as follows:

- Throughput limit. Gaseous ions existing at atmospheric pressure, provided e.g. by electrospray ionisation ("ESI"), have only a certain maximum density, which is determined by the space charge forces which tend to force ions apart and the diffusional effects. Thus the throughput of gas from the atmospheric region into the interface determines also the ion current that may enter the interface. Thus only the increase of the gas throughput into the interface may increase the ion current that can be transmitted from the atmospheric region. Gas throughput of the prior art devices are limited due to the named reasons.
- Diffusion losses. At least some prior art devices transmit gaseous ions through a narrow long capillary. The capillary diameter is typically 100 times smaller than the length. In such high aspect ratio device, the gaseous ions that are entrained within the gas flow have very low probability to be transmitted through the capillary without colliding with the inner walls of the capillary, once the ions are travelling within the body of the capillary, the main loss mechanism is diffusional losses.

Space charge losses. These are also significant as they limit the current of ions that may pass through the capillary, these space charge losses are dependent on the concentration of the sample to be analysed. Samples of high concentration suffer higher losses due to space charge forces. Space charge effects may reduce the transmission of ions through the capillaries even when sample concentration is not high, this is because the ESI can produce a high concentration of solvent ions which travel through the capillary together with the sample ions.

Focusing losses. Without special measures at the entrance of the capillary inlet, an electrical field is present due to the ESI probe voltage, the penetration into the mouth of the capillary forces the entrancing ions towards capillary internal walls.

Losses due to high gas speed. When all the gas flow is supersonic, the gaseous ions entrained in the flow effectively follow the flow and it is not possible to employ electrical fields to significantly influence the ion flow. Furthermore high, supersonic gas speed results in shock waves and in turbulence. The shock waves disperse the gaseous ions and high turbulence results in losses comparable to a high increase in diffusion.

In support of the present invention iterative simulations were undertaken to investigate gas dynamic effects in the interface and conditions preferred to reduce the gas velocity and the turbulence. Several geometries and conditions being studied. The resulting gas flow fields were used to study the ion movement, and the possibilities to focus the ions by electrical fields.

The present inventors understood that in prior art devices, particularly those having capillaries, ions are transmitted with very low efficiency: a majority of ions passing from a capillary interface are emitted from charge droplets passing into the capillary.

If one aims to increase the evaporation of droplets in the atmospheric region, one must find a means to more efficiently transport ions from residing at atmospheric region in to the vacuum chamber containing means for mass analysis. This aim motivated the present inventors to research the subject matter of the current disclosure.

The present inventors were keen to improve the limit of detection for LCMS devices, and to further develop the technology to reach a detection limit in the low Zeptomole range. That means to detect/identify a substance, when only several Zeptomoles ($10^{-21}$) moles of that substance are injected. To this aim an experimental application program interface ("API") was constructed. The experimental data provided basic understanding that electrical fields may be used to focus ions only when the product of gas pressure and velocity is sufficiently low. This led to the development of the present invention. Methods to reduce the gas speed through the interface region were sought. At the same time, it was understood from study of the charge density effects, it is preferred to increase the gas throughput from the atmospheric pressure region into the ion transport device.

In devising the present invention, the present inventors were trying to achieve:

a) An increase in the ion current that may be transmitted through an interface from the atmospheric pressure region. The present disclosure teaches methods to accept a higher gas throughput from atmospheric region and to separate gaseous ions from a high pressure gas stream or jet.

b) An increase in the transmission efficiency of ions through the interface, that is, a high proportion of ions entering the ion interface preferably passes out of the exit, that is the transmission efficiency is preferably be high.

c) More ions, i.e. a higher proportion of available ions at the atmospheric pressure region, passing into the interface.

Potential advantages to a user may include:

a) Increased dynamic range of analysis (the highest to lowest ratio of sample ions concentration that may be submitted without saturation effects).

b) A lower level of concentration of sample ions may be analysed; that is a lower limit of detection ("LOD") or instrument detection limit ("IDL").

The studies referred to above led to the realisation that it is preferable to maintain the gas velocity subsonic and preferably substantially subsonic, at least in the higher gas pressure portion of the interface. U.S. Pat. No. 6,943,347 was known at this time, but the findings of the present inventors teach away from this prior art. The jet pressure ratio ("JPR") is a key aspect: by controlling it, it is possible to limit the gas speed. As a consequence one may define a sequence of pressure controlled chambers having small pressure drop between chambers so to transport ions from an initial (high) pressure to a final (low) pressure. One may also define aspects of geometry of the multi-chamber interface for effective operation.

Here is a non-exhaustive list of what is considered to be 'new and clever' aspects of the present disclosure:

1. A device for transporting ions from atmospheric pressure comprising a plurality of interconnected pressure controlled chambers.
2. Imposed fixed pressure ratios to maintain the gas flow sub sonic in a device for transporting ions comprising a plurality of interconnected pressure controlled chambers, preferably with defined pressure limits.
3. DC lenses in combination with a device for transporting ions comprising a plurality of interconnected pressure controlled chambers.
4. DC lenses with decelerating and accelerating fields within a high pressure region of an ion transport device, preferably in combination with a device comprising a plurality of interconnected pressure controlled chambers.
5. A combination of DC and RF focusing in a single ion transport device.
6. A Gas Transparent ring guide in a lower pressure portion of a device for transporting ions comprising a plurality of interconnected pressure controlled chambers.
7. A device for transporting ions comprising a plurality of interconnected pressure controlled chambers having a plurality of parallel channels.

Preferably:

The velocity of the gas jet is kept sufficiently slow through the transport device.

The jet pressure ratio between adjacent chambers is maintained within certain limits.

A geometry of the pressure controlled chambers is correctly defined.

As a result, it is preferred that:

A defined proportion of gas is removed from the main jet at each pressure controlled chamber.

A sufficiently low outward radial flow from a gas jet is achieved to allow focusing of ions against the flow for ions having a wide range of mobility values.

Slow gas flow through the ion transfer device prevents the formation of a Mach region and provides a reduction of the turbulence formed within the downstream jet. Turbulence in the gas jet may be quantified by the turbulent viscosity ratio ("TVR").

Low values of TVR results in lower ion losses through the device. It may be considered that the ion diffusion is increased by a factor equal to the value of the TVR.

Certain aspects of electrostatic lenses to keep ions focused to the axis of the device are also considered. Firstly, the electrostatic lens preferably provide an adequate field strength to focus the ions. It is also desirable for there to be zero potential difference between adjacent chambers. To achieve this, there is proposed the use of focusing and defocusing regions as described below ("DC focusing schemes").

Continual focusing of ions towards the central axis requires a continually increasing axial field having a non-zero second derivative of the potential with respect to the axial position coordinate. Although theoretically valid, and effective for some conditions, this type of focusing is not practical in all cases due to the high probability of electrical breakdown.

The location of the focusing and defocusing action within the chamber is preferred to maintain ions within the main gas jet.

These aspects will be illustrated by means of example embodiments.

Figure 2A:
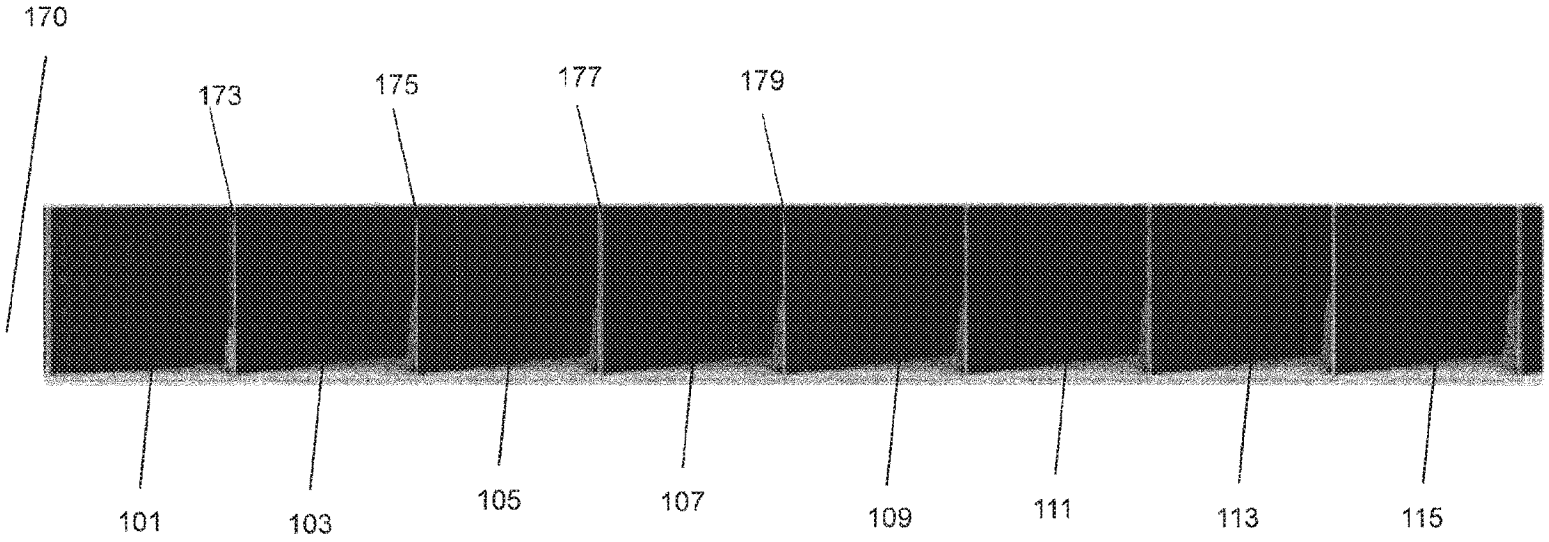
FIG. 2(*a*) and FIG. 2(*b*) show a representation of the gas jet passing through the consecutive pressure-controlled chambers of FIG. 1, calculated using a method of computational fluid dynamics. The shades of grey represent the gas velocity magnitude.
Figure 2B:
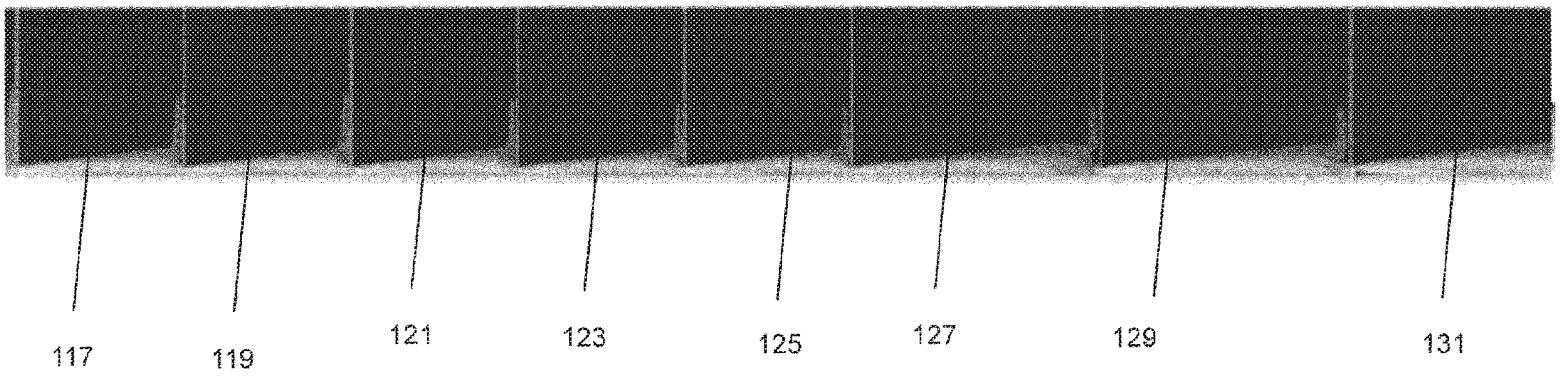
Figure 5:
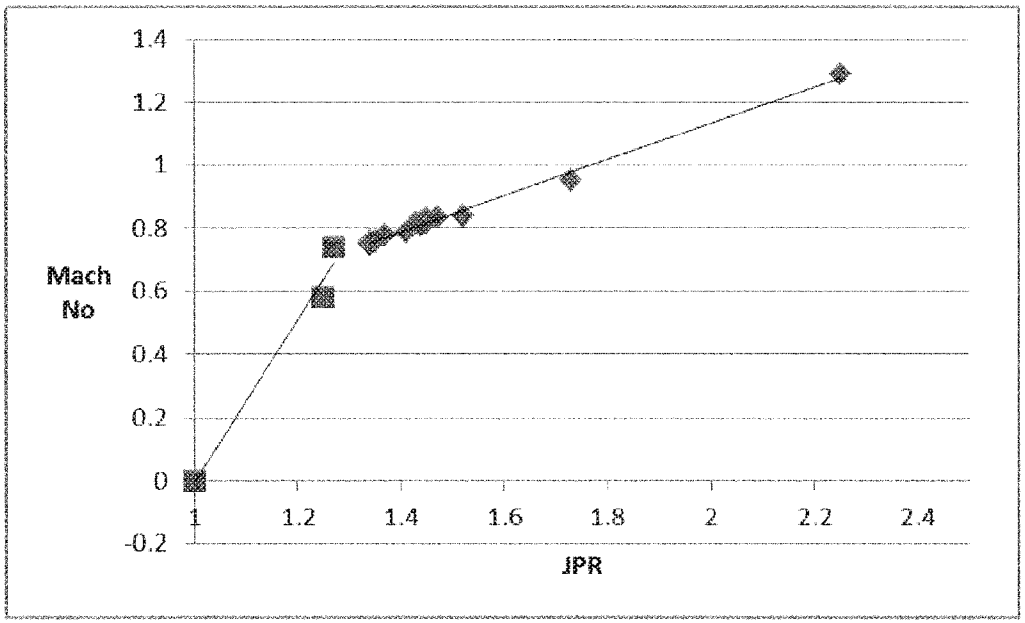
FIG. 5 shows a plot of Mach number (ratio or the speed of gas to the speed of sound) of the gas jet at the entrance of the pressure controlled chamber as a function of the jet pressure ratio (JPR).
Figure 6:
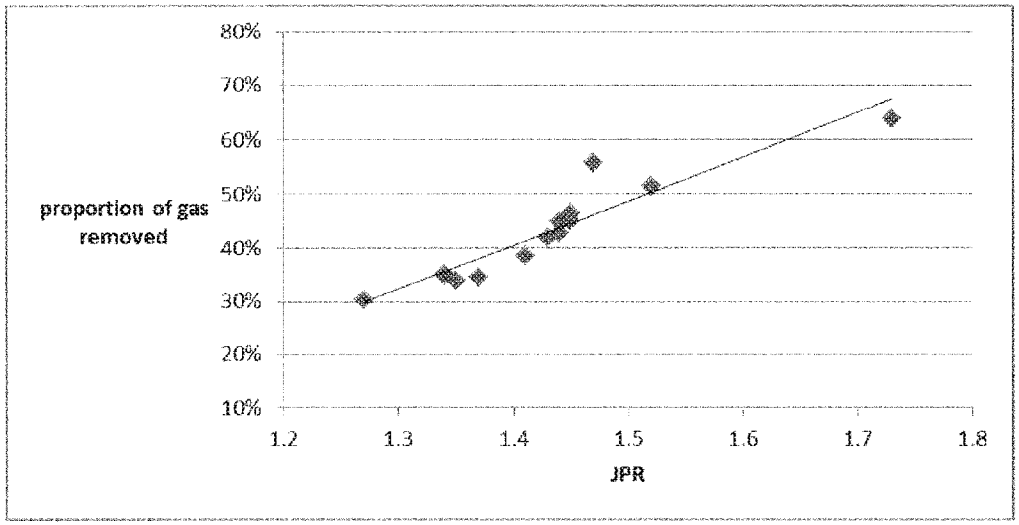
FIG. 6 shows a plot of the percentage of gas removed by the pumping system in each of the pressure-controlled chambers as a function of the JPR.

FIG. 1 shows a plurality of chambers (numbered 1 to 29). Chamber 1 has an entrance aperture 82 and exit aperture 84. Gas flowing into chamber 1 is at atmospheric pressure. The pressure of gas in chamber 1 is lower than atmospheric pressure and is determined by aperture 41. The pressure in chamber 3 is further lower than the pressure in chamber 1, and the pressure in chamber 5 is further lower than chamber 3. The ratio of the gas pressure between consecutive chambers is referred to as the jet pressure ratio ("JPR"). Gas flow enters chamber 1 as a confined jet and goes through the consecutive chambers from chamber 1 to chamber 29. The mass flow rate of jet is gradually reduced as the gas flows from chamber 1 towards chamber 29. FIG. 2(*a*)-(*b*) shows a representation of the gas jet passing through consecutive chambers of the interface. This figure was calculated by a method of computational fluid dynamics ("CFD"). Areas of lighter shading represent higher gas velocity magnitudes. The data shown in FIG. 2(*a*) represents, with reference to FIG. 1, chambers 1, 3, 5, 7, 9, 11, 13, 15. The data shown in FIG. 2(*b*) represents, with reference to FIG. 1, chambers 17, 19, 21, 23, 25, 27, 29. The corresponding chambers are labelled 101 to 129. Parameters used to obtain these plots are tabulated in FIG. 3. Data is given for chambers 1, 3, 5, 7, 9, 11, 13, 15, 17, 19, 21, 23, 25, 27, 29. FIG. 2(*a*) shows atmospheric region 170, and following chambers 101, 103, 105 etc. to 115. Each chamber wall has an aperture of diameter 2 mm located on axis. The walls of the chambers are spaced initially at 20 mm with latter chambers spaced at 30 mm. For the purpose of the simulation each chamber was considered to be independently pumped. Ion optic focusing elements with each chamber are not shown. The velocity of the gas jet dependent of the Jet pressure ratio (JPR) is shown by FIG. 5. The JPR increases from 1.25 between atmospheric region and chamber 101 to 1.52 between chamber 123 and 125. This choice of JPR is sufficiently low to prevent the formation of shock waves within each chamber and that the gas flow remains subsonic in all chambers. The JPR may be decided by the pumping speed applied to each pressure controlled chamber. This is illustrated in FIG. 5. The gas speed preferably does not exceed a Mach value of 0.81 (1 Mach being the speed of sound) as long as the JPR does not exceed 1.44. It can be further seen from FIG. 2 that gas expands in each chamber in radial direction. The flow is confined to the surface of the chamber end walls, 173, 175, 177, 179 etc. The proportion of gas flowing radially and not passing into the adjacent downstream chamber may be controlled by a combination of the JPR and the geometry of the chamber. More specifically the ratio of spacing between chamber walls, l and the diameter of the aperture, d, may be chosen to determine the proportion of gas to be removed in each chamber. In this embodiment the value of l/d varies from 10 to 25. The mass flow of gas removed and the mass flow of gas remaining in the jet through each pressure controlled chamber is shown by FIG. 3. The percentage of mass flow of gas removed in each of chambers 103 to 129 is shown in FIG. 6. The portion of the gas removed increases with the increasing JPR and is largely independent of the chamber pressure. Thus JPR may be used to vary the amount of gas removed in each chamber. The higher the JPR the more gas will be removed in each chamber for a fixed geometry.

The amount of gas removed in each chamber influences the strength of focusing needed to maintain ions closer to the axis of the gas jet.

With reference to the theory, the velocity of an ion in the gas media within the 1$^{st}$ part of the device (higher pressure part) may be described by the following equation:

$$\vec{v} = \vec{u} + \frac{10^5 K_o \vec{E}}{P} \qquad \text{Equation 1}$$

$K_o$ is the ion mobility coefficient at atmospheric pressure ($1\times10^5$ Pa) and P is the local gas pressure in Pascal. Eq. 1 holds in the region of continuum physics. A typical value for $K_o$ in LCMS applications is in the region of 0.0001 $m^2/(V\cdot s)$ and a typical electrical field at atmospheric pressure is of $10^6$ V/m. The electrical field causes the ion to drift at a maximum velocity of ~100 m/s. Thus an electrical field $<10^6$ V/m can't move an ion against a flow of gas at pressure $1\times10^5$ Pa that is greater than 100 m/s. However, at a pressure of $1\times10^3$ Pa the same electrical field causes the ion to drift at a velocity of 10,000 m/s. However, a safe maximum electrical field at $1\times10^3$ Pa is ~$2\times10^5$ V/m, giving a maximum velocity for the ion of 2,000 m/s. This is a maximum theoretical limit, in practice one is able to use significantly lower fields as many ions would be caused to fragment in smaller subunits at such field strength (the electrical field is so strong that it heats up resulting in the fragmentation). This limit may be defined by the E/N value (Electrical field divided by the number density of the gas), usually measured in units of Townsend (Td), where 1 Td=$1\times10^{-21}$ $V/m^2$. Ions may fragment at E/N>~100 to 200 Td. In this example of $1\times10^3$ Pa (10 mbar) a maximum field strength is ~$5\times10^4$ V/m which corresponds to an ion drift velocity of an ion having a reduced mobility 0.01 $m^2/Vs$ of 250 to 500 m/s. This corresponds to Mach numbers of 0.75 to 1.5. A further restriction on the electrical field strength that may be employed in a general ion transmission device comes from the consideration that one must transmit ions having a range of mobility values. Typically in the range $K_o \approx 6\times10^{-5}$ to $3\times10^{-4}$ $m^2/(V\cdot s)$, that is a factor of 5. This imposes some further lowering of the upper limits of ion drift velocity and thus gas velocity. Eq. 1 is a very simple expression employed to describe the ion drift velocity in ion mobility devices. To understand ion motion in the present device, a more detail analysis of the ion interface is insightful. Eq. 1 is more generally expressed as:

$$\vec{v}_j=\vec{u}+K_j\vec{E}-(1/\rho_j)(D_j grad\rho_j) \quad \text{Equation 2}$$

Where $\vec{v}_j(x, y, z, t)$ is the velocity of ion of type j at point x, y, z at time t, $K_j$ is the reduce mobility of ion of type j, $D_j(x, y, z, t)$ is the diffusion coefficient for the charged particles of type j which depends, in particular, on gas pressure and temperature at point x, y, z. $\vec{u}(x, y, z)$ is the velocity of the neutral gas at point x, y, z and $\vec{E}(x, y, z, t)=-\text{grad } U(x, y, z, t)$ is the electric field intensity where U(x, y, z, t) is the electric potential.

$$\frac{\partial \rho_j}{\partial t}+div(\rho_j\vec{v}_j)=0 \quad \text{Equation 3}$$

$$div(\varepsilon\varepsilon_0\vec{E})=div(-\varepsilon\varepsilon_0 gradU)=\sum\rho_j \quad \text{Equation 4}$$

These equations may be solved as a system using numerical methods. Software was prepared by the present inventors for this purpose. Such a system of equations takes into account not only the gas flow and electrical field, but also the influence of diffusion and the total space charge density $\Sigma\rho_j$. This system of equations has validity only in the continuum flow regime, and when the external variables change with respect to time and space coordinates only slowly. Furthermore, implicit in Equation 2 is that the ion velocity is constant, or rather changes slowly compared to the characteristic relaxation time of the ions. For the purposes of describing the present examples, the system of equations is valid to a pressure range >1000 Pa providing only DC voltages are employed, and no shock waves in the gas flow are formed.

Figure 4A:
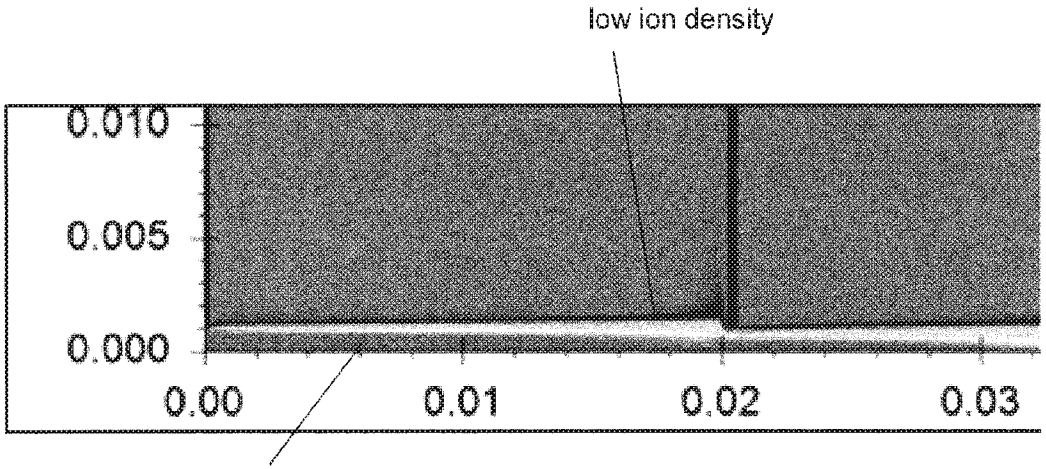
FIG. 4(*a*) and FIG. 4(*b*) show calculated plots of ion density, for gas flow into and out of a pressure-controlled chamber, without any ion focusing and with ion focusing elements installed respectively.
Figure 4B:
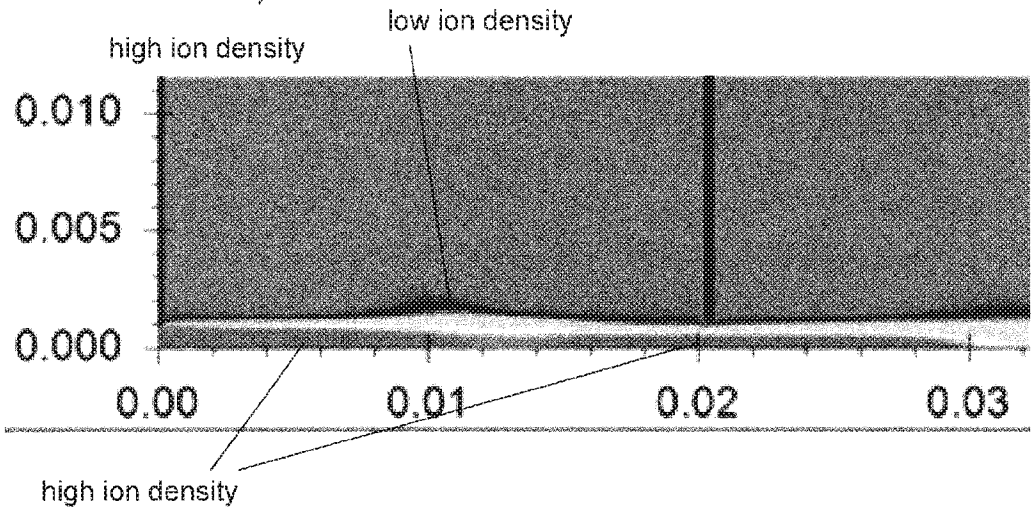

The results of the simulations are described with reference to FIG. 4(*a*)-(*b*). FIG. 4(*a*) and FIG. 4(*b*) show plots of ion density as calculated using the methods described above, and using the conditions described above. Both show the ion flow into chamber 101 and from chamber 101 in to 103.

FIG. 4(*a*) shows the ion density without any focusing elements, it can be seen that a proportion of ions flow away with the radial gas (such gas flow is shown in FIG. 2(*a*)). In FIG. 4(*b*) ion focusing is installed, using a lens of the type shown in FIG. 7(*a*). Gas flows from the atmospheric region through aperture 782 in to 1$^{st}$ pressure controlled chamber 701, which contains lens elements 790 and 792. In calculation of the ion density distribution in FIG. 4(*b*), voltages of 0 V and 250V were applied to lens elements 790 and 792 respectively. These lens elements act to focus ions towards the axis 794 in the region of exit aperture 702. An important feature of the focusing elements is that radially inward focusing of ions is provided in the region before the exit aperture. As a result of this focusing ions are not carried away with the radial gas flow, as shown in FIG. 4(*b*).

These voltages provide a field intensity not exceeding $10^5$ V/m at the pressure of the 1$^{st}$ chamber (E/N of the focusing field is relatively week, <10 Td, it is in what is known as the low field range). As a result the focusing effect of the electric field is not strongly dependent upon the $K_j$ of the ion. Further understanding of this aspect of the present disclosure is provided by FIG. 7(*b*). There is shown the pressure control chamber 103 having entrance aperture 102 and exit aperture 104 together with defined regions 802 and 800. These regions are bound by contours of the radial gas flow velocity. 802 bounds the region where the radial outward (positive) gas velocity is in excess of 60 $ms^{-1}$. 800 bounds the region in which the radial inward (negative) gas velocity exceeds 30 $ms^{-1}$, and in the throat of the aperture radial inward gas velocity exceeds 100 $ms^{-1}$ Upstream of these regions the radial gas flow does not exceed 3 $ms^{-1}$. Thus ions approaching aperture 104 within the radial distance of region 800 will be carried through aperture 104 into chamber 105 by the gas jet, and ions approaching aperture 104 at a radial distance greater than the inner limits of region 802 will be carried radially outwards and will be lost to the pumping system. It should be understood that each subsequent chamber will have a similar distribution of the radial gas velocity and so similar focusing schemes are applicable.

Figure 7A:
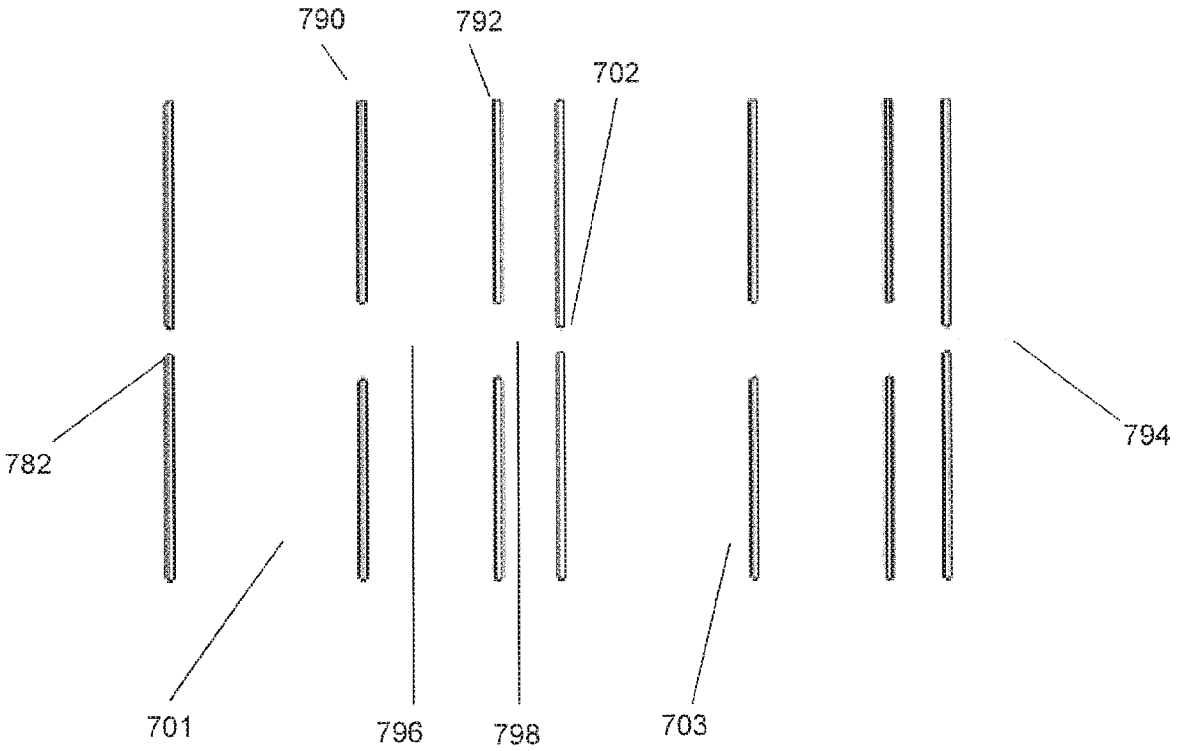
FIG. 7(*a*) shows a schematic diagram of two subsequent pressure controlled-chambers in which focusing elements are installed.
Figure 7B:
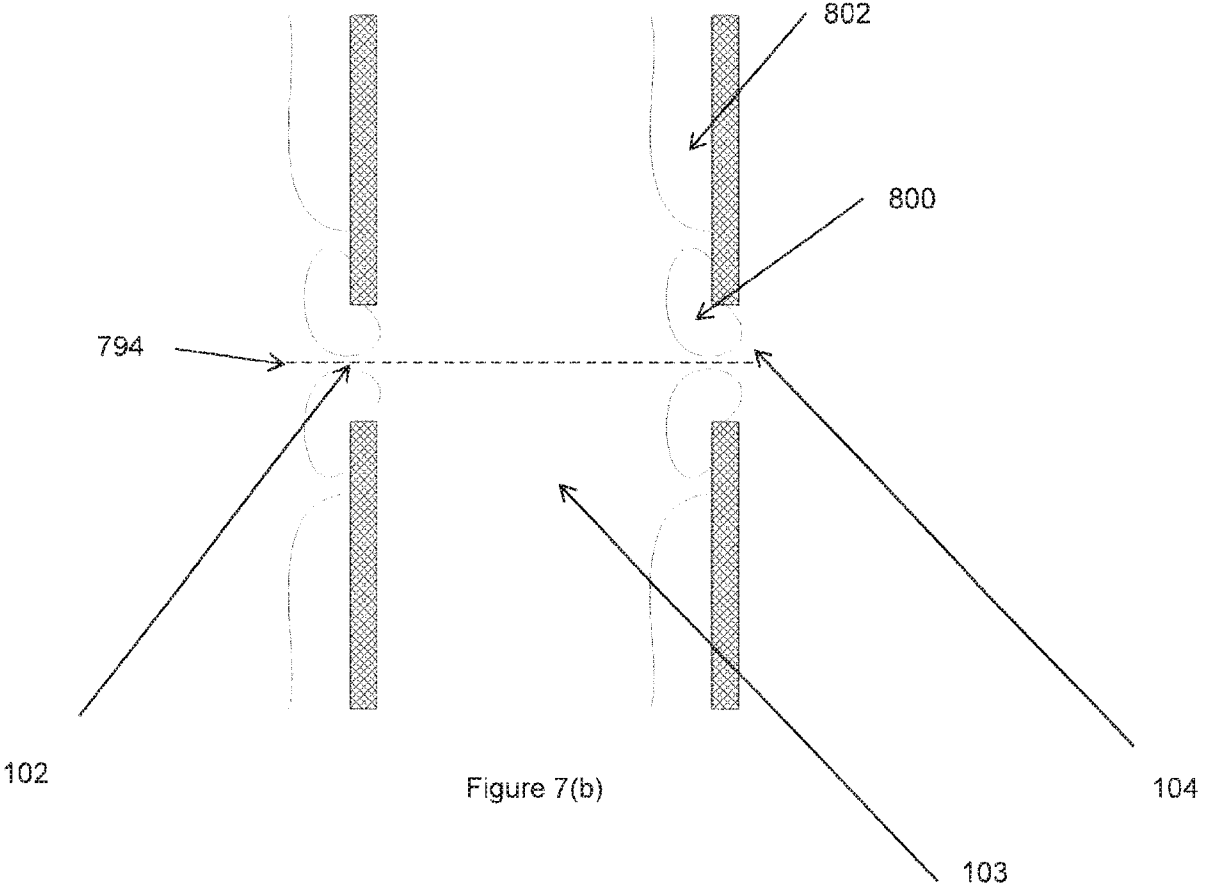

Thus in preferred embodiments the focusing is most effectively arranged to provide focusing in the region 'just before' the exit aperture of the chamber. The chambers may conveniently be arranged so that chamber walls 173, 175, 177, 179 etc. are at a common potential. With reference to FIG. 7(*a*) voltages are applied to provide a defocusing region 796 and focusing region 798. The lens elements are arranged sufficiently far from the gas jet so as not to influence the flow of the gas jet.

Figure 8:
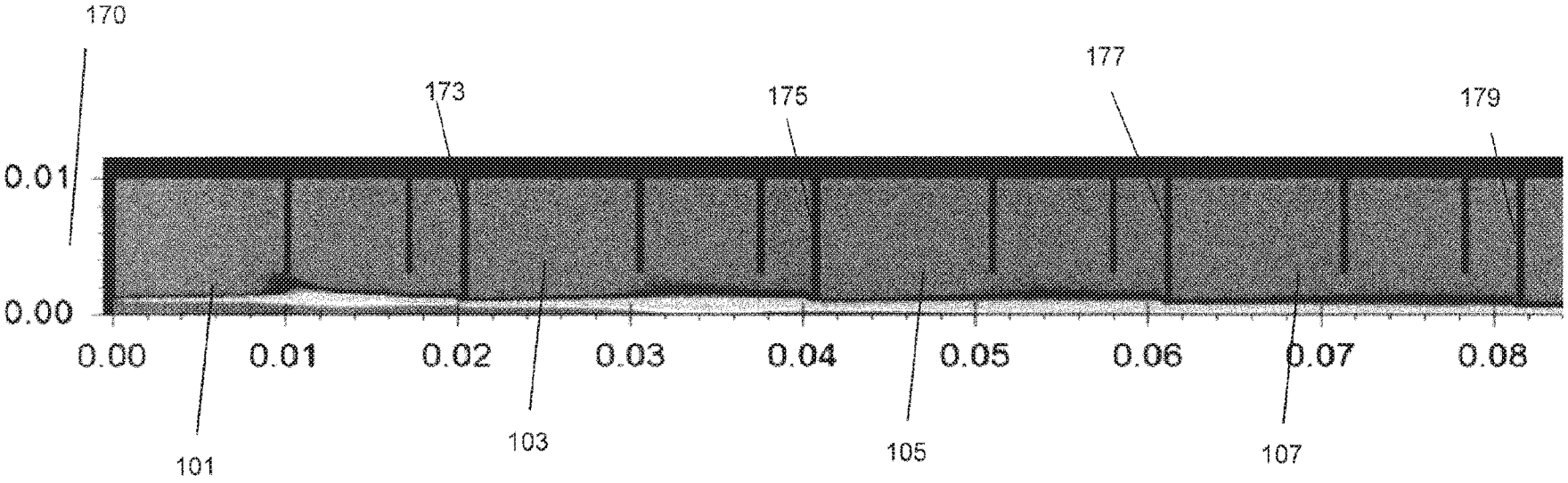
FIG. 8 shows a calculated plot of ion density for gas flow through a series of pressure-controlled chambers with two focusing elements placed along the axis of each chamber.

FIG. 8 shows the ion density development from the chambers 101, 103, 105 and 107. Similar data for further chambers, 109, to 125 was also generated (not shown here).

Details of this simulation were as follows. Pressure in each pressure control chamber was set according to FIG. 3. A voltage of 500V was applied to a lens located in chamber 101 (FIG. 2(*a*)-(*b*)), and the voltages were reduced in proportion to the pressure in the subsequent chambers, such that the voltage applied in chamber 119 was 32.5 V. A pressure ratio between chamber 101 and 119 of 22 was achieved. In this example all chambers' end walls were set to 0V. Thus the DC lenses were operated in decelerating/accelerating mode.

Figure 9:
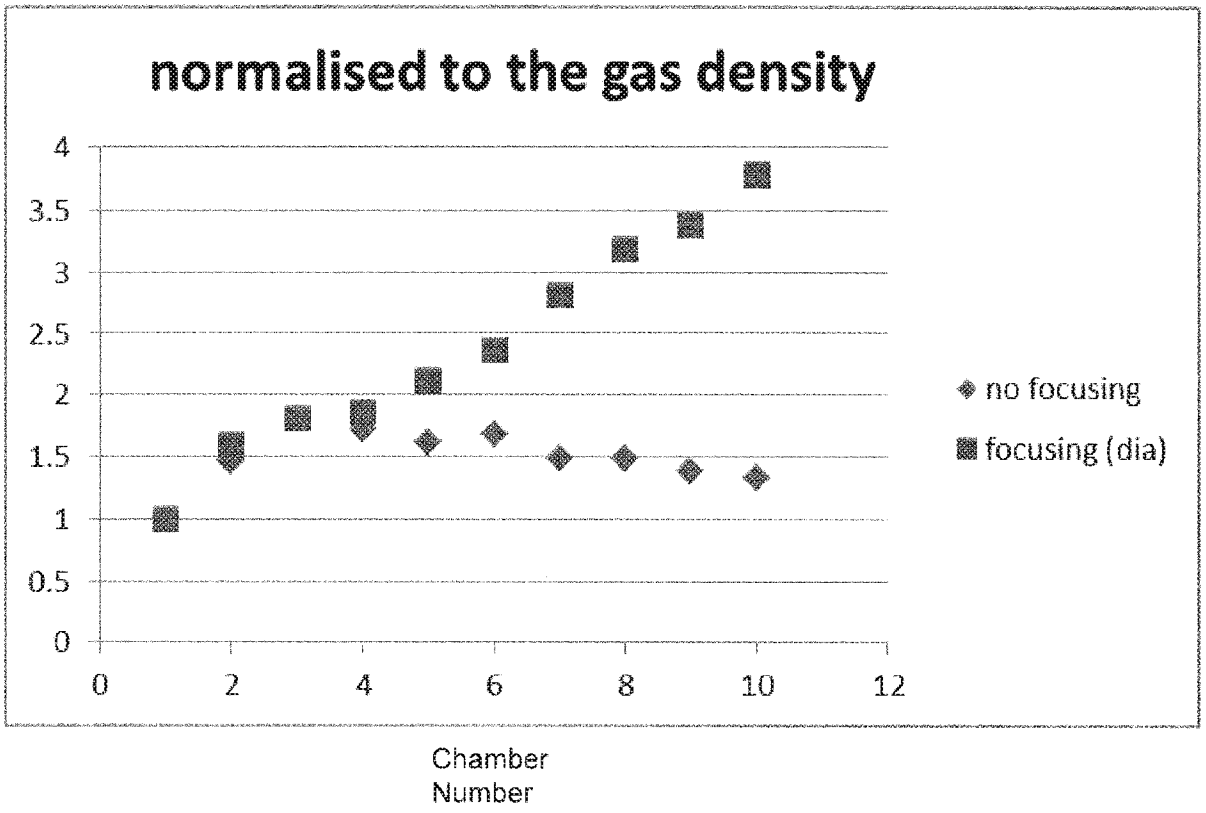
FIG. 9 shows a plot of ion transmission, with and without focusing, through a series of ten pressure-controlled chambers.

Ion transmission through chambers 101, 103, 105, 107, 109, 111, 113, 115, 117, 119 (a total of 10 chambers) of the described embodiment is shown in FIG. 9. Data is shown for the purposes of comparison, with and without focusing. In each case the ratio of normalised ion density to the normalised gas density is plotted, [ion density]/[gas density]. Without any focusing active in the pressure controlled chambers the ion density reduces approximately proportionally to the gas density. By comparison, when focusing is active in the pressure controlled chambers, [ion density]/[gas density] increases by a factor of nearly 4 and ion transmission through the chambers 101 to 119 is ~20%.

Figure 10:
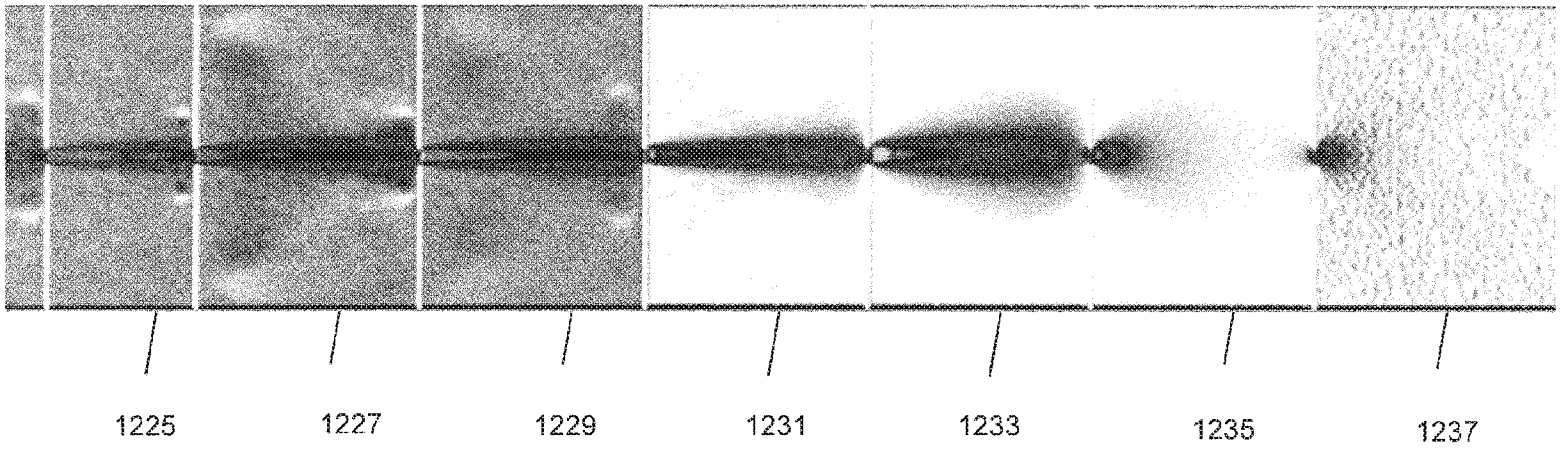
FIG. 10 shows a DSMC (direct simulation Monte-Carlo) simulation of the gas flow field for a series of pressure-controlled chambers, along with a table displaying data from the simulation.

The interface has further pressure controlled chambers, to transport ions to further lower pressure. The current embodiment has further chambers 121, 123, 125, 127, 129, 131, 133, 135 & 137. The gas flow field in the corresponding pressure controlled chambers 1225, 1227, 1229, 1231, 1233, 1235, 1237 are shown in FIG. 10 (note that the pressures stated are the pressures for the downstream chamber corresponding to the stated pressure ratio). In chamber 1225 the chamber end walls are separated by 20 mm, in chambers 1227, 1229, 1231, 1233, 1235 and 1237 the walls are separated by 30 mm. The JPR in these chambers is set respectively at 1.44, 1.45, 1.43, 1.52, 1.47, 1.73, 2.25, 4.17, 5 and 12. The pressure in these chambers corresponds to 3100, 2160, 965, 560, 250, 60, 12 and 1 Pa. A gas jet continues to be established through chambers 1225, 1227, 1229, 1231, 1233 which may be demonstrated by a direct simulation Monte-Carlo ("DSMC") calculation of the gas jet, as shown in FIG. 10. The jet becomes progressively more divergent as the pressure is reduced and the JPR is increased. In pressure control chamber 1235 the jet no longer persists and the gas flow reduces practically to stand still at the midpoint of the chamber. The JPR between chamber 1233 and 1235 is 5 and the pressure in chamber 1235 is 12 Pa (0.12 mbar). The flow is divergent and gas speed reduces rapidly in all directions. The JPR between chamber 1235 and 1237 is 12 and the pressure in chamber 1237 is 1 Pa (0.01 mbar). The gas flowing in to chambers 1235 and 1237 approaches that of a cosine distribution as expected for molecular flow conditions.

Thus, in FIG. 10, the JPR increases from 1.52 between atmospheric region and chamber 101 to 5 between chamber 1133 and 1135. This choice of JPR is sufficiently low to prevent the formation of a shock wave within each chamber and that the gas flow remains subsonic in all chambers except chamber 1235, which has a Mach number of 1.17. However, as the jet does not reach the chamber end wall and the pressure is already reduced to 12 Pa, there is no loss of ions.

Whereas chambers 1 to 19 of the embodiment may use DC focusing, it was found by the inventors that for subsequent chambers 21 to 37 DC focusing becomes decreasingly effective and for chambers 21 to 37 RF focusing is more effective than DC focusing. In the current embodiment a stacked ring guide of ID 3 mm and inter-electrode spacing of 1 mm was used in pressure controlled chambers 25 to 29 (pressure range 1400 to 5600 Pa. In chambers 31, 33, 35 and 37 the spacing may be increased to 2 mm and the diameter to 6 mm in the pressure range 250 to 1 Pa (2.5 mbar to 0.01 mbar). In these chambers a different method of assessing ion transmission is required because continuum physics is not valid at these conditions. To study the transmission of ions through chambers 21 to 37 of the current embodiment, a Monte Carlo simulation is used, (individual particle tracking) and the gas flow field is obtained by the direct simulation Monte Carlo ("DSMC") method. Considering the chamber 1225 of FIG. 10, the pressure is 1420 Pa giving a increase in mobility 0.0071 $m^2/Vs$ ($K_o$=0.0001 $m^2/Vs$). The drift velocity whilst maintaining the applied field within the low field limit (E/N<10 Td) provides an ion drift velocity of 25 $ms^{-1}$. The diffusion coefficient also scales with pressure, as $D_j$ may be expressed in terms of the reduce mobility (see Equation 5). $D_o=2.6*10^{-6}$ [$m^2/s$] for $K_o$=0.0001 [$m^2/Vs$]. So in chamber 1225 diffusion is a factor 70 larger than at atmospheric pressure. DC fields can be used to focus ions towards the axis, but they cannot reduce the diffuse scattering of the ions that is pronounced in the lower pressure regions. However, RF fields work well under low pressure providing the means to repel ions towards the axis, i.e. focusing them.

$$D = \frac{k_b T}{e} K \qquad \text{Equation 5}$$

Figure 11:
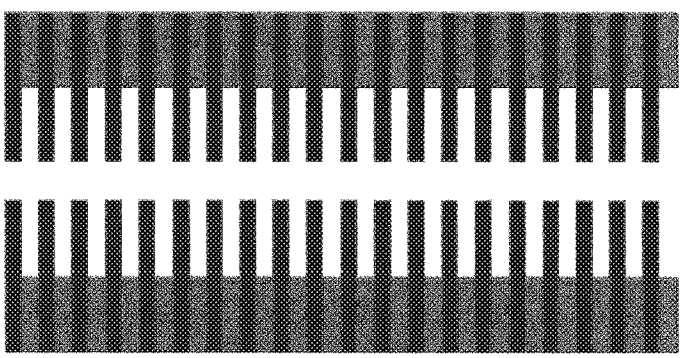
FIG. 11(*a*)-(*e*) show possible electrode configurations for a focusing device (ion guide).
Figure 11:
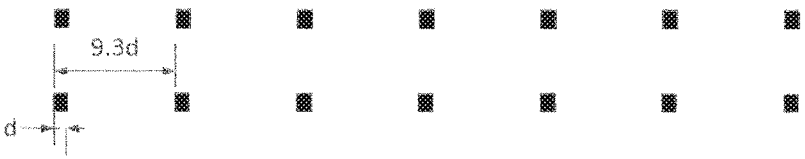
Figure 11:
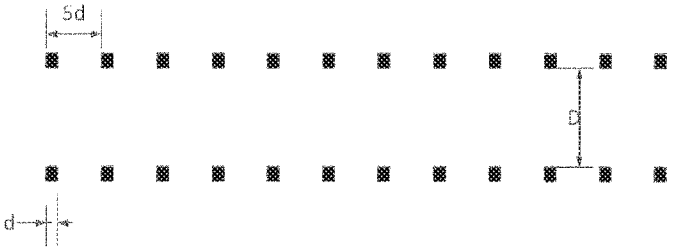
Figure 11:
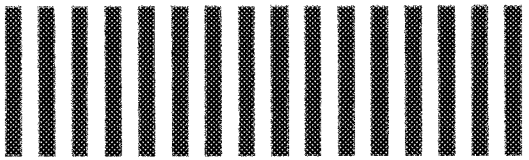
Figure 11:
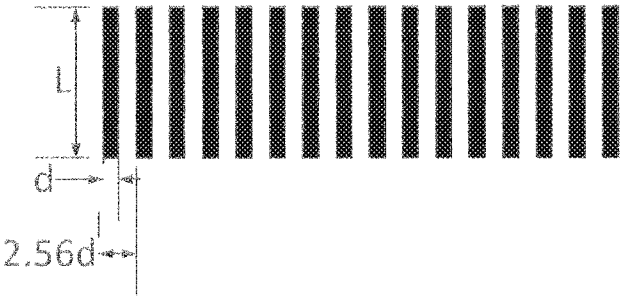
Figure 11:
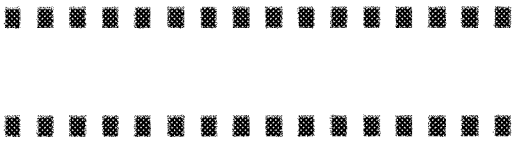

As found by the inventors, a key aspect of the stacked ring guide, when applied to an interface having a plurality of pressure controlled chambers, is the aspect of gas transparency. A gas transparent ion guide has a structure which is effective to allow gas to escape or flow out radially largely unhindered through the walls of the ion guide. This type of ion guide is described further with reference to FIG. 11. Structures (a) and (c) represent structures of the prior art. In (c) the electrodes are spaced by insulating rings, and it is clear that no gas is able to pass out radially and so all gas passing into the input will pass out the output, that is the gas throughput at the input is equal to that of the output. In the context of the multi-chamber interface, this causes a build-up of the gas pressure at the exit aperture of the chamber and ions loss. Although structure (a), also described in the prior art, provides gaps between the electrodes, a study of the gas dynamics shows that this structure is equivalent to (c) and no significant amount of gas is able to pass out of the structure radially. Note that structure (a) is characterised by L>>d, and d~f (f is the electrode spacing). Here L is the thickness of the electrodes in radial direction, d is thickness of the electrodes in axial direction. In FIG. 11(*a*) f=2.65 d, the gap between the electrode is thus 1.65 d. Structure (b) is an improvement on (a). In thus structure L=d and f=2.65 d. This structure also has limited gas transparency and is not a preferred embodiment. Structure (d) is characterised by the L=d, and the f>>d, it is drawn as 9.3 d. This structure has very good gas transparency, but due to the large spacing the pseudo potential between the rings will not retain the ions inside the structure. Structure (e) provides L=d and f=5d and D=2f, where D is the inner diameter of the structure and represents a preferred embodiment for the stacked ring guide. Structure (e) will provide both transparency to the gas, but also confine ions. The diameter of the D is preferably chosen to be comparable to the diameter of the gas jet.

Figure 12:
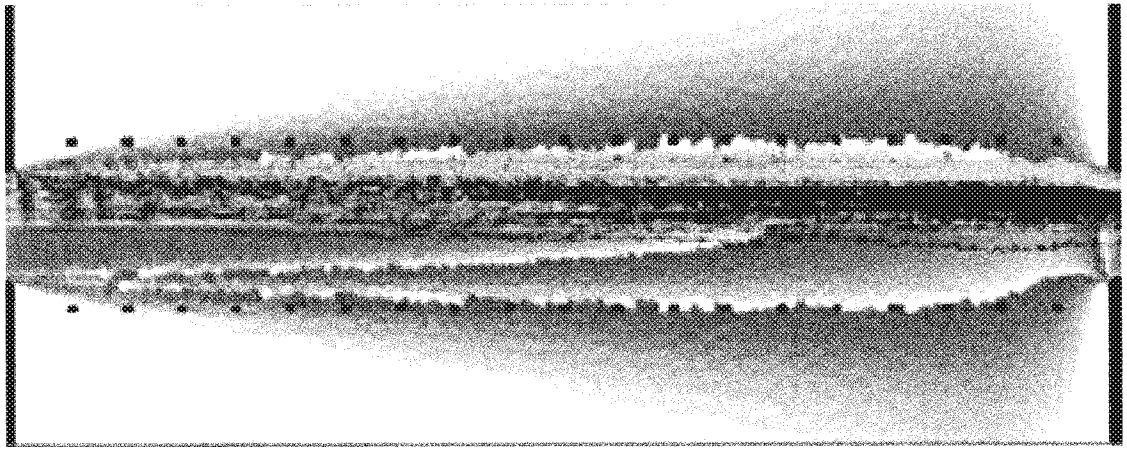
FIG. 12(*a*) shows a simulation of ion trajectories passing through a pressure-controlled chamber with a focusing device (ion guides).
Figure 12:
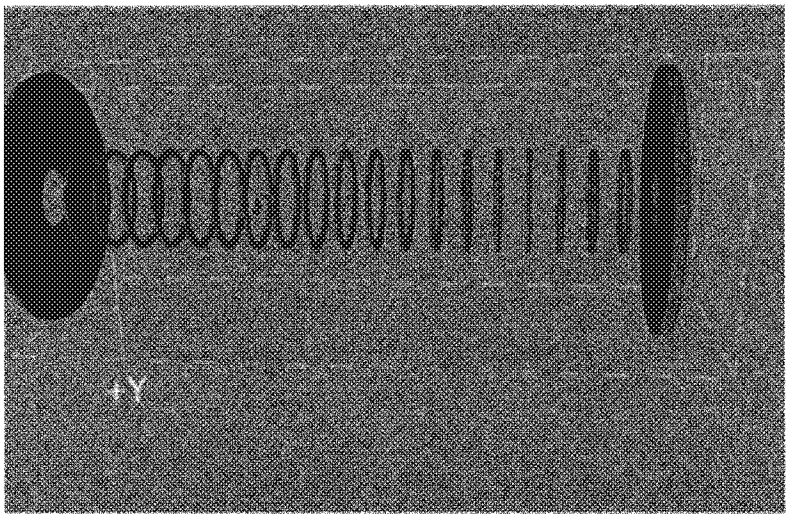

An ion simulation of a preferred embodiment is shown in FIG. 12, which shows ion trajectories passing through chamber 1225 (see FIG. 10). In this simulation L=d=0.2 mm, f=1 mm and D=3 mm. The trajectories are plotted in the mass range m/z=200 Th to 1000 Th, with the collision cross section adjusted appropriately to the mass of the ions. There are no ions losses, all ions initiated at the input aperture to chamber 1225 pass through the exit aperture, the transmission is 100%. Similar simulations, performed for chambers 1227, 1229, 1231, 1235 and 1237, show the same result of 100% ion transmission. As the pressure is reduced through chambers 1225 to 1237, the RF focusing becomes more effective at moving ions against the radial gas flow. As ions approach the exit, they are converged by the radially inward gas flow.

Figure 13:
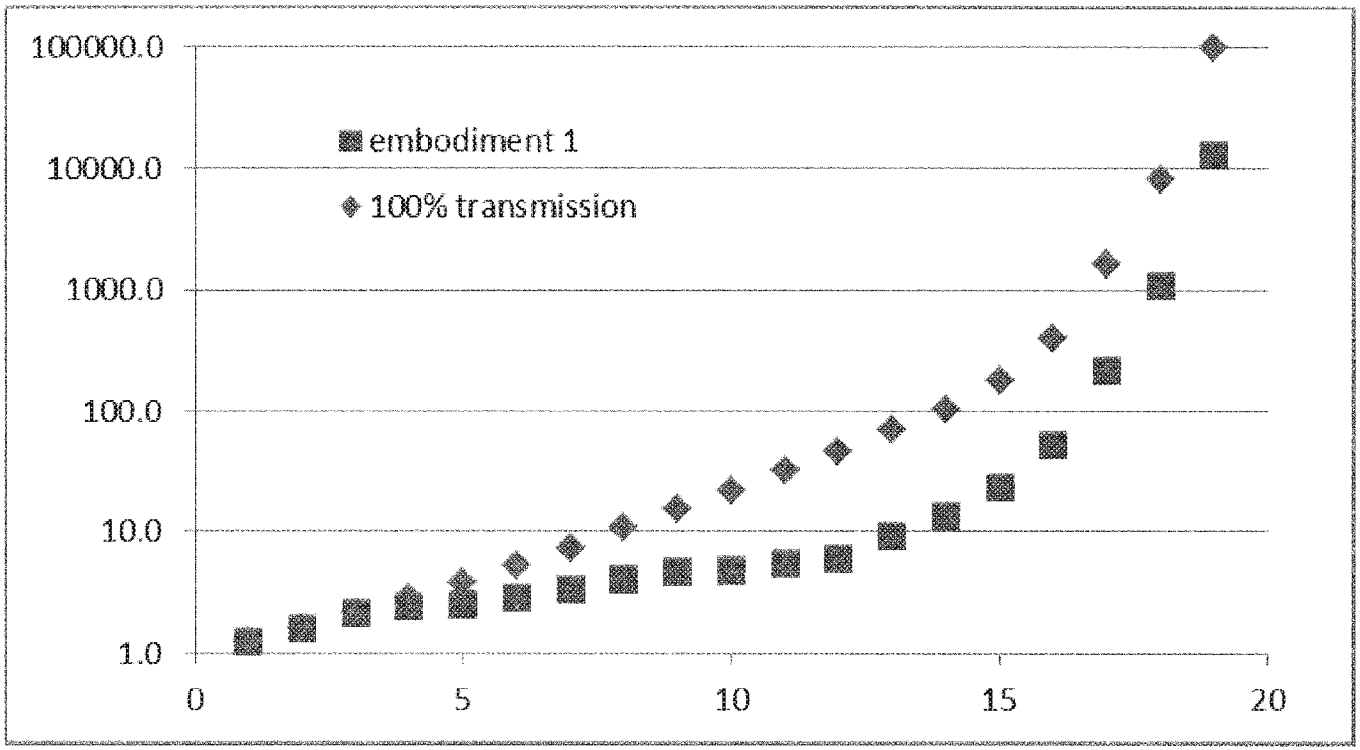
FIG. 13 shows a plot of ion transmission through a series of pressure-controlled chambers with ion guides in accordance with a preferred embodiment of the invention.

The device may be constructed from chemically etched sheets, which provides a fine pitch of the ring guide and simultaneously provides high gas transparency. The transparent ring ion guide may have an ID comparable to the pressure limiting apertures used for separating the pressure controlled chambers The ion density to gas density ratio, [ion]/[gas], through the described embodiment of the entire interface from chambers 1 to 37 is shown by FIG. 13.

Figure 14:
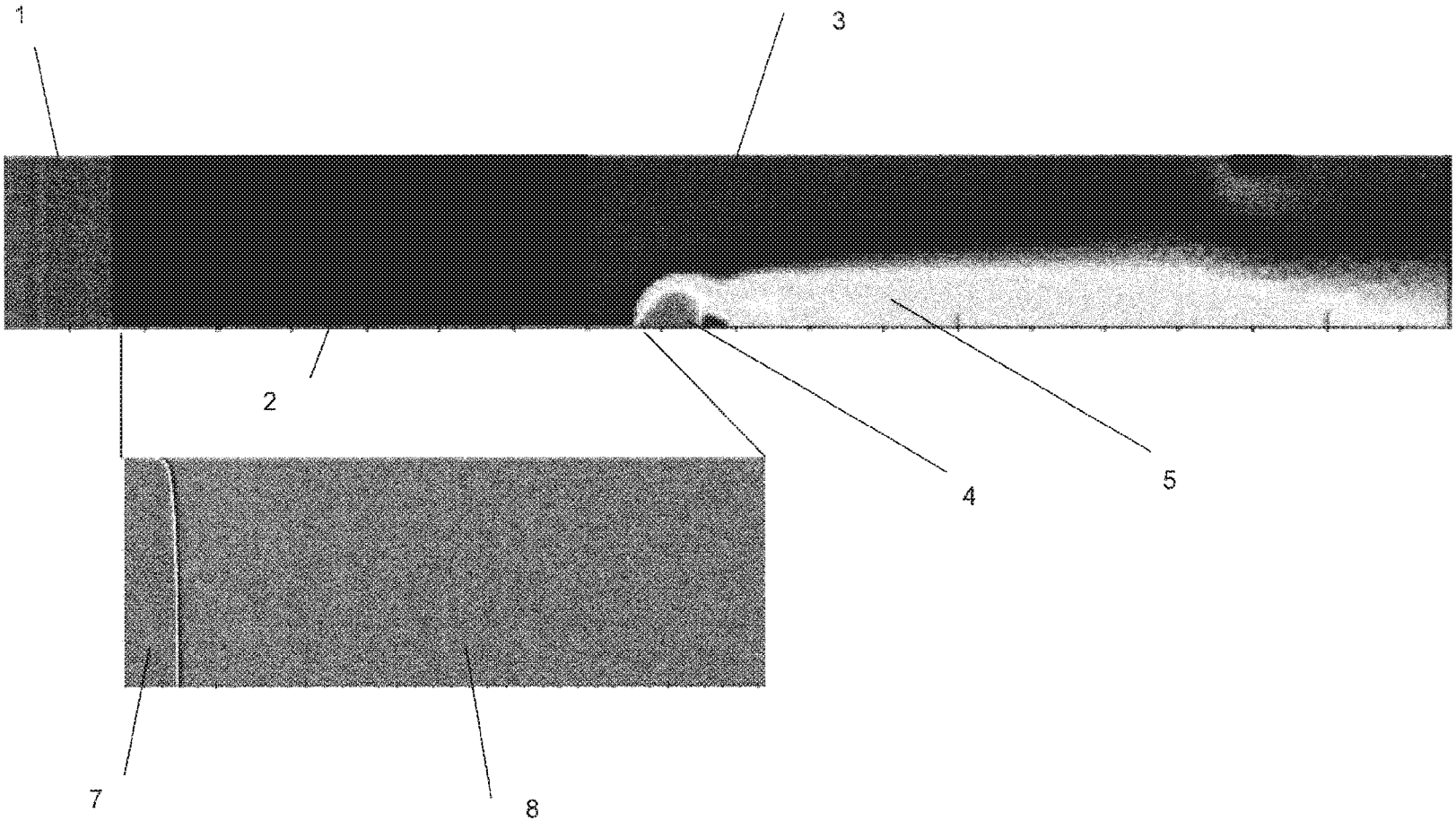
FIG. 14 shows calculated plots of gas velocity and ion density along a capillary, one end of which is held at atmospheric pressure, the other of which is held at 2 kPa.

A prior art system that the present invention seeks to improve upon is that of the heated capillary interface also referred to as a 'desolvation line'. This type of interface and its shortcomings were introduced above. Here is some supporting evidence of these statements. FIG. 14 shows a capillary 2 of ID 0.5 mm and length 70 mm, the capillary having a $1^{st}$ end in which gas flows from the region 1 which is held at atmospheric pressure ($10^5$ Pa) and a $2^{nd}$ region 3 from which the gas is issued and is held at a pressure of 2 kPa (20 mbar). Due to the high JPR a Mach region 4 is formed at the $2^{nd}$ end (outlet end) followed by supersonic Jet 5. This system is widely employed with commercial MS systems. Let us use the same methods as was used to calculate the ion density in the multiple chamber (MC) interface as described above. The inflowing gas was considered to carry the ions of an initial density through the capillary; and the variation of the ion density transmitting through the capillary was considered. For this calculation data from the CFD calculation was imported, distributions of gas velocity, pressure and temperature and turbulence. FIG. 14 also shows a representation of the ion density along the capillary. In region 7 of FIG. 14 the ion density is $>10^{-6}$ of the initial density and in region 8 the ion density is $<10^{-6}$ of the initial density. The data shows that only 0.0001% of ions are transmitted further than the first several millimetres of the capillary. This data effectively shows that ions created in the atmospheric region are not transmitted into region 3. Thus it may be inferred that ions transferred through the capillary to vacuum region 3 do so within solvent droplets that are not evaporated in region 1. The charged droplets entering the capillary entrained within the gas flow and only liberate ions within region 3. By comparison, the multiple chamber device disclosed within the present disclosure is many orders of magnitude more effective for transmission of ions from atmospheric region as compared to the prior art interface. It is a preferred aim of the present invention to transport gaseous ions formed within the atmospheric pressure region in to vacuum.

Supersonic gas jets are normally formed within gas interfaces due to significant pressure drop between the pumped chambers of the interface. Such gas structures promote unnecessary widening of the gas jet, formation of clusters of ions with water; they form undesirable shock waves and turbulent regions that scatter the ions away from the axis of the interface. These effects are particularly difficult to counteract when the supersonic expanding jet is formed in the first chamber of the interface. Apart from the capillary type inlet, a variety of jet disrupting and avoiding techniques are used in prior art (for example, see "A multicapillary inlet jet disruption electrodynamic ion funnel interface for improved sensitivity using atmospheric pressure ion sources" referred to above). Normally such techniques result in increase of turbulence and inevitable ion losses. The present disclosure employs a method to avoid the formation of supersonic jet keeping the properties of the gas flow under control, reducing the turbulence, keeping gas speed low and reducing the radial scattering of the ionised species entrained within the gas flow. Moreover, it teaches the way to input the ionised gas directly into the interface, therefore increasing the gas (and thus ion) throughput from the atmospheric region.

Figure 15:
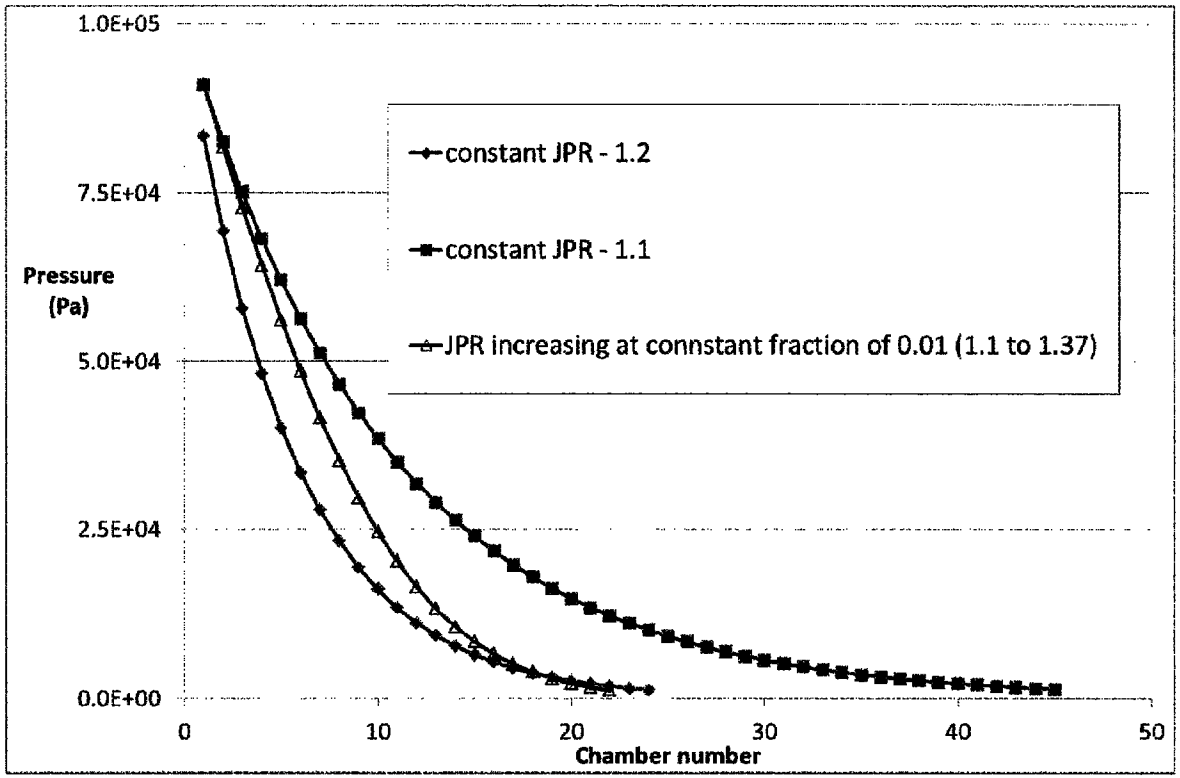
FIG. 15 shows a plot of pressure against chamber number in an interface for different values of JPR.

The following represent preferred features/conditions/operating ranges for implementing the present proposals (of course, these values/ranges may depend upon individual application requirements and size constraints):

- JPR profile: The JPR profile set out above is only one example. Many other examples may be considered provided that the gas jet velocity does not exceed Mach 1, and is preferably significantly less than Mach 1. Some example JPR profiles are shown in FIG. 15. Lower JPR will provide a slower gas jet, which can be expected to provide lower ions losses overall, but the will lead to a longer interface.
- % gas removed: The gas flow removed per chamber may be in the range 5% to 50%.
- Chamber geometry: The ratio of spacing between chamber walls, l and the diameter of the aperture, h, in the end walls of the chamber may be chosen to determine the proportion of gas to be removed in each chamber. Generally the value of l/h may vary from 5 to 50. This ratio may be constant throughout the device, or most generally may be varied along the device.
- Diameter h: h may be typically in the range 0.1 mm to 5 mm.
- Focusing: The device may have DC focusing only or DC and RF focusing.
- Pressure range for the transition from DC focusing portion to RF focusing portion: Typically the pressure at which DC focusing is changed to RF focusing is $3'10^3$ Pa to $0.25*10^3$ Pa, $P_t$ (threshold pressure).
- Pressure range of DC focusing portion: Typically $10^5$ Pa to $P_t$. This are preferred values, though in principle the initial pressure could be any pressure $>P_t$
- Range of RF focusing: typically $P_t$ Pa to 1 Pa, $P_t$ to 10 Pa.
- Gas transparent ion transfer device: L=0.5d to 1.5 d and f=3d to 6d and D=1.5f to 10 f.

Multi-Channel Device ("Parallel Embodiment"):

Prior discussion was limited to an interface with a single channel (single path). A single channel system however suffers a number of restrictions. In order to achieve enhanced gas throughput one must have set apertures in the 1st several chambers as large as possible. A skimmer opening to 2 mm provide a gas throughput that is higher by a factor of 32 greater than most prior art devices.

The present disclosure allows for further increases in gas throughput intake, and is limited only by the investment in the pumping system and the size of the device. The diameter of the aperture h in each pressure controlled chamber in turn determines l the spacing between chamber walls. Thus simply increasing the diameter h of a single aperture will lead to a device that is too long to be viable for use in commercial LCMS system. To provide maximum transmission the JPR may be reduced to 1.1. As shown in FIG. 15, setting the JPR to 1.1 would require 45 chambers to transport ions from at $1^{st}$ pressure region of $10^5$ Pa to a second (lower pressure) region of <1400 Pa. To achieve, for example, a 15% reduction, the value of l/h is preferably 10, and thus for h=2 mm, the chamber is preferably l=20 mm, as described above. Thus the total length of the device assuming h to be constant for all pressure controlled chambers would be 45×20 mm, giving a total length of 900 mm. Although feasible for high end bespoke instrumentation, ultimately this length would become a disadvantage in commercial implementation. An effective solution can be a multiple chamber ("MC") interface having parallel channels. An MC interface having a plurality of channels thus falls within the scope of the present disclosure. As the size of the gas jet scales with the diameter of the inlet aperture, the overall length of the structure may be scaled with aperture size. Gas throughput may be maintained by increasing the number of apertures. FIG. 16(*a*) gives the radius and number of apertures assuming a required gas acceptance flow rate of 460 mbar l/s and the length of the DC focusing portion assuming that the constant JPR of 1.1 is used to deliver ion to a pressure region <1400 Pa. For example a reduction of the apertures from 1 mm to radii 0.25 mm would require 16 apertures in each stage. The length of the DC focusing portion of the interface would reduce from 900 mm to 225 mm. Thus the parallel embodiment of the MC interface may provide acceptable dimension to the application of commercial LCMS instrumentation. An example of a structure having a plurality of chambers is shown in FIG. 16(*b*) and FIG. 16(*c*). FIG. 16(*b*) shows the cross sectional view as viewed from the front of the device. FIG. 16(*c*) shows the cross sectional view as viewed from the side of the device, only a proportion of 45 pressure controlled chambers are shown. The device shown has 16 apertures 5, in each stage of the device. The pressure control chamber is divided into equal 16 segments 3, each of which is in fluid communication with pumped region 1. Each pressure controlled chamber 9, is formed from conducting sheets 11, which form the chamber endplates and insulating spacers 9. The insulating spacers have apertures to determine the pressure in the pressure controlled chambers. Optionally the endplates may have formed grooved for guiding the gas to the exit apertures, e.g. as described in PCT/GB2015/051569 (currently unpublished, but relevant extracts from which are included in the present disclosure as an Annex). The chambers may contain focusing elements in each chamber as described above. Optionally the endplates may be formed from PCBs and may be used to deliver voltages to the lens electrodes. These are not shown in FIG. 16. An additional advantage of the parallel embodiment of the MC is that focusing may be achieved with reduced voltages applied to the electrodes.

Figure 17:
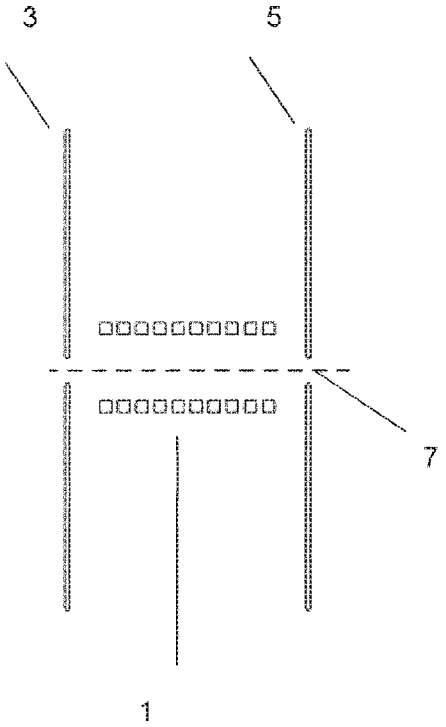
FIG. 17(*a*) shows a schematic diagram of an electrode structure in a pressure-controlled chamber which may be used in various schemes of DC voltage application.
Figure 17:
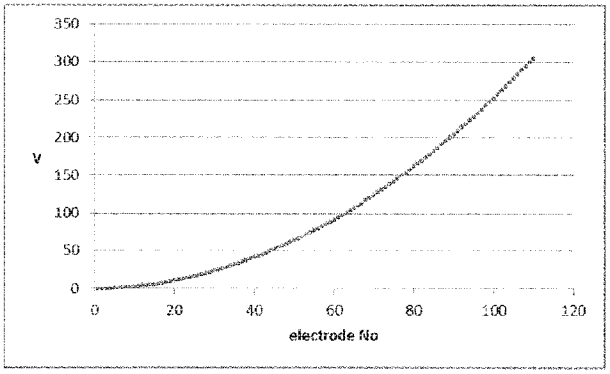
Figure 17:
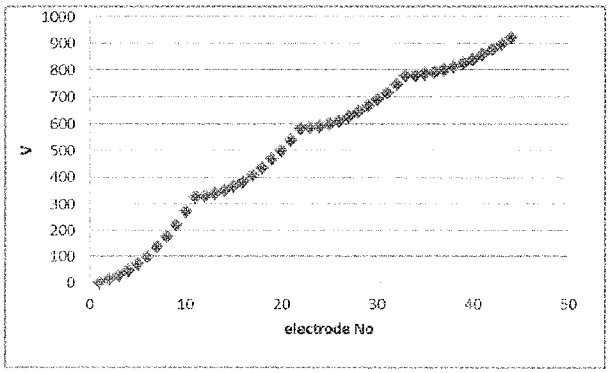
Figure 17:
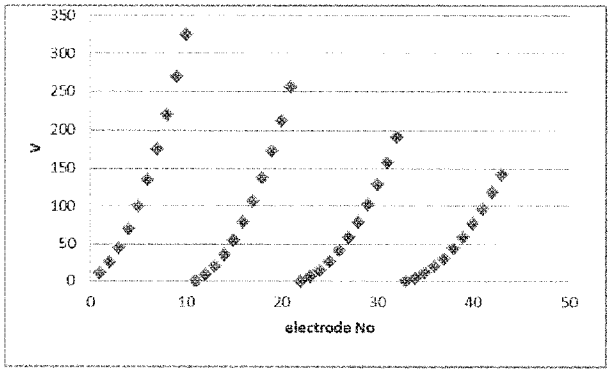

DC Focusing Schemes:

For this embodiment and the voltages employed in each chamber could not be operated in accelerating mode only as the sum of all lens voltages of 2052 kV would be preferred, for the embodiment described above. This voltage is not practical in low vacuum chamber as the electrical breakdown would occur, so the embodiment described above may be restricted to alternately accelerating and de-accelerating schemes. By converting the embodiment described above to a parallel scheme with 64 apertures would scale the system dimensions by a factor of 8 and in this embodiment the applied voltages could be scaled by a factor of 8. Thus the maximum voltage difference would reduce from 2052 V to 256 V. Voltages of 200 to 400 V are feasible and are routinely employed in MS interface of pressures 100 Pa or higher. An electrode structure that may be employed for an accelerating scheme is shown in FIG. 17, which shows the lens structure located in a single pressure controlled chamber, the same of similar structures may be repeated all chambers of the DC focusing portion of the MC interface. The lens consists of a tube lens, formed from a stack of closely space ring electrode. In this example there are 10 ring electrodes in each chamber. An example of an accelerating voltage profile is shown in FIG. 17(*b*), the potential continually increases without interruption from one chamber to the next. FIG. 17(*b*) shows the voltage that applied to the 10 chambers of the embodiment described above, each chamber having the tube lens with 10 electrodes, or 11 electrodes for each pressure controlled chamber including the chamber end electrode. In this focusing scheme the accelerating potential has 1 positive 2nd order derivative at all positions along the axis.

Further focusing schemes are shown in FIG. 17(*c*) and FIG. 17(*d*). FIG. 17(*c*) is similar to that of accelerating scheme of FIG. 17(*b*), however the strength of the focusing is reduce in each chamber in proportion to the pressure drop. This results in discontinuities in the potential and a negative $2^{nd}$ derivative of the potential. FIG. 17(*c*) shows the potential calculated for the $1^{st}$ of 4 chambers of the MC interface. At the location of the negative $2^{nd}$ derivative defocusing of ions will result. In the MC interface this defocusing due to the negative figure $2^{nd}$ derivative of the potential may be arrange such that it occurs at the same axial location of the strongly radially inward gas flow. This radially inward flow is located just before and inside the exit aperture of each pressure controlled chamber. A further focusing scheme using the tube lens is shown in FIG. 17(*d*). This is another example of accelerating/de-accelerating scheme. It is similar to the scheme of FIG. 17(*c*) but the defocusing is stronger between chambers. Inside each tube lens, there is a potential with a $2^{nd}$ derivative for focusing ion towards the axis of the device.

The apparatus as described above is intended for use in any LCMS instrumentation, it could be fitted to any instrument with hardware modifications. It is also applicable to any ionisation method taking place at atmospheric pressure such as nanospray, direct ionisation methods, AP-MALDI. It is expected that the device would be used for next generation instrument only, although a factory retrofit would in principle be possible.

When used in this specification and claims, the terms "comprises" and "comprising", "including" and variations thereof mean that the specified features, steps or integers are included. The terms are not to be interpreted to exclude the possibility of other features, steps or integers being present.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

All references referred to above are hereby incorporated by reference.

Annex—Extracts from PCT/GB2015/051569

These extracts from PCT/GB2015/051569 are included to provide background as regards the possible construction and operation of an ion transfer apparatus including a plurality of pressure-control chambers.

In this Annex, the figures have been renumbered to avoid conflict with the other figures in this patent application, and the claims have been relabelled as "statements" to avoid confusion with the claims of this patent application.

Examples of preferred embodiments of the invention will now be described for the purposes of illustrating the invention in some implementations. It should be understood that the invention is not limited to any one of these embodiments.

Figure 18:
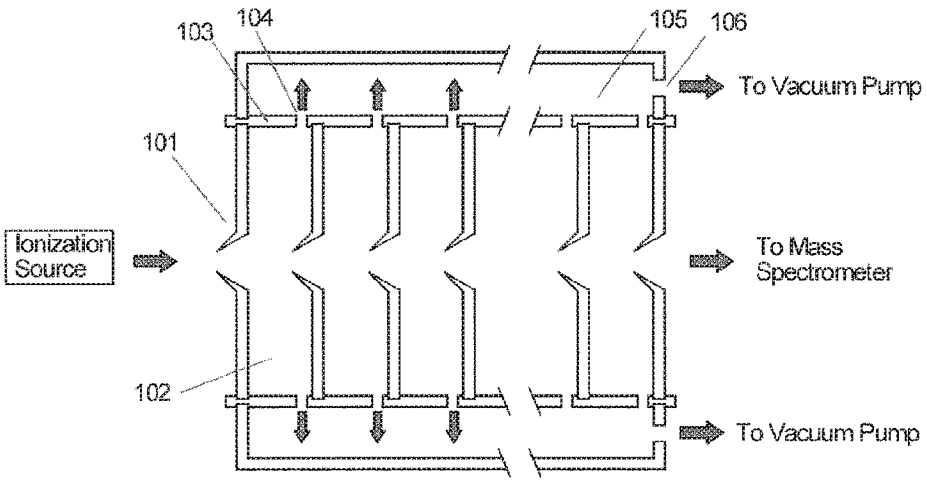
FIG. 18-FIG. 22 are drawings relating to an Annex, described in more detail below.
Figure 19:
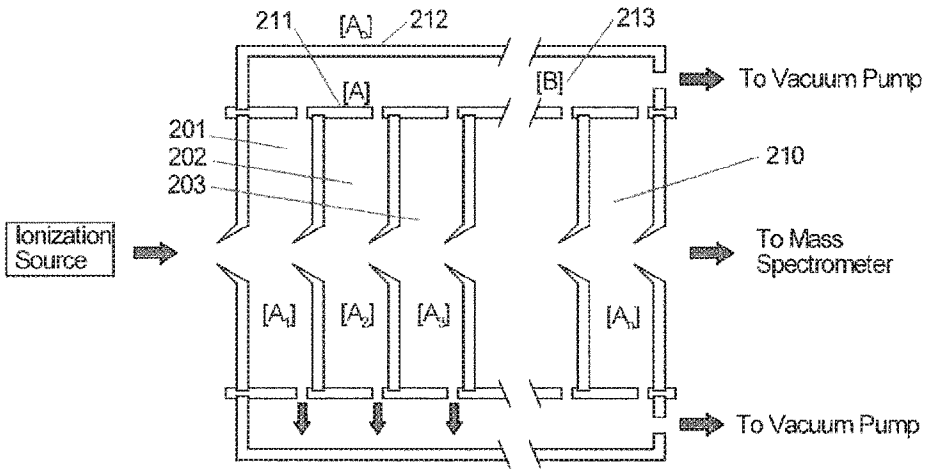
Figure 20:
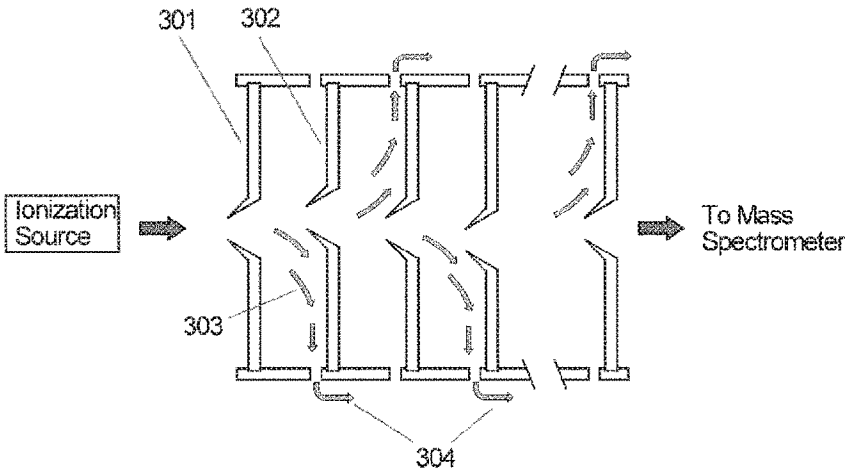
Figure 21:
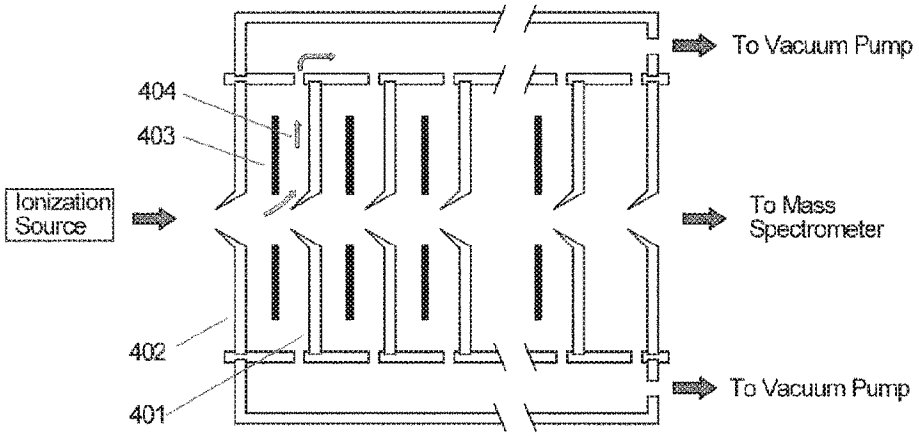

FIG. 18 is a schematic illustration of a generalized arrangement of a skimmer-electrode array according to an embodiment of the invention;

FIG. 19 is a schematic illustration of a generalized arrangement of a skimmer-electrode array according to an embodiment of the invention;

FIG. 20 is a schematic illustration of a generalized arrangement of an array designed with off-axis skimmer-electrodes according to an embodiment of the invention;

FIG. 21 is a schematic illustration of a generalized arrangement of an array equipped with focusing electrodes to collimate the ions and simultaneously channel the flow.

Figure 22:
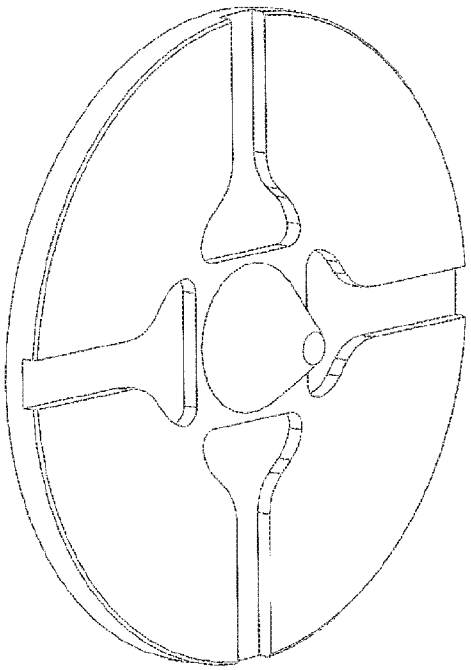

FIG. 22 is a schematic illustration of a skimmer (which may also serve as an electrode) machined with slots extending radially outwards to collect and direct the gas toward respective pressure exhaust openings.

An illustrative example of an embodiment is described with reference to FIG. 18. A skimmer-shaped electrode 101 is positioned at the entrance of the array to sample ions produced in the ionization source. Ions are preferably produced by electrospray ionization although other ionization methods readily apparent to those skilled in the art can also be employed. A proportion of an electrospray plume of charged droplets is directed towards or orthogonal to the first skimmer electrode 101 with a circular inlet aperture or ion inlet opening that may greater than 2 mm in diameter. A series of similarly shaped skimmer electrodes is positioned further downstream using insulating rings 103. Region 102 established between the first two skimmer-electrodes defines the pressure control chamber volume which is partially evacuated through a series of pressure exhaust openings or orifices 104 arranged symmetrically on the first insulating ring 103. Region 102 is therefore in fluid communication with the pumping line 105 connected to a vacuum pump through port 106.

The gas load presented to the second skimmer electrode is reduced by an amount equivalent to the amount of mass flow rate subtracted by the suctioning action of orifices 104 while pressure in the second region or second pressure-control chamber established between the second and third skimmer electrodes positioned by the second insulating ring is lower. A second set of orifices on the second insulating ring removes part of the remaining gas load to reduce pressure in the third region of the array further. Pressure is therefore reduced progressively from the entrance to the exit of the array thus permitting the use of wide aperture sizes to be employed as a means to enhance ion conductance. Pressure levels in each of the regions established between neighbouring skimmer electrodes is controlled by adjusting the dimensions of the skimmer aperture sizes and the dimensions of the orifices within insulating rings 103 used for pumping gas. Electrostatic focusing can be employed by application of appropriate DC potentials to the skimmer electrodes to focus ions in-through the apertures with high transmission efficiency. The entire array is preferably operated at elevated temperature to promote desolvation of charged droplets.

The skimmer array of FIG. 18 can form an integral part of a mass spectrometer interface where the final stage or region of the array is operated at a pressure of approximately 1 mbar. Subsequent vacuum regions equipped with standard RF ion optical elements typical to those employed in modern mass spectrometers and operated at pressure below 1 mbar can be connected at the far end of the array. In another preferred embodiment the final stage is maintained at an elevated pressure, for example at a pressure of 100 mbar, and the array is coupled to the standard inlet of a mass spectrometer equipped with conventional ion optical systems, for example RF ion optical devices such as the ion funnel or other types of RF ion guides devices operated at approximately 10 mbar and readily known to those skilled in the art. In this preferred embodiment the gas load presented to the entrance of the 10 mbar vacuum region is reduced considerably compared to existing interface designs where pressure is reduced from 1 bar in a single step, therefore the dimensions of the inlet can be increased significantly.

FIG. 18. is a schematic illustration of a generalized arrangement of an atmospheric pressure mass spectrometer interface comprising of a skimmer-electrode array designed to reduce pressure from the ionization source pressure to a lower pressure level in a progressive manner whilst ion transmission is enhanced compared to existing interface technology.

A method for the parameterization of the device in order to specify the dimensions of the apparatus is made with reference to FIG. 19. In this preferred embodiment the apparatus consists of a number of consecutive skimmers and ring spacers forming successive regions 201, 202, 203 and 210 designated with $[A_1]$, $[A_2]$, $[A_3]$ and $[A_r]$ respectively. An array design with additional stages between regions 203 and 210 can be implemented but only four regions are shown for simplicity. The skimmer electrodes and ring spacers are shaped into a primary conduit 211 designated with [A] with a predetermined diameter. A secondary conduit 212 designated with $[A_o]$ is arranged coaxially and externally to the primary conduit 211 to produce an inner gap, which defines the pumping line 213 designated with [B]. This is the lowest pressure region evacuated using a vacuum pump. All regions 201, 202, 203 and up to the final stage here designated with 210 are in communication with the pumping line 213 through a series of orifices on the insulating ring spacers, similar to the orifices 104 presented in FIG. 18. The method disclosed herein is concerned with the determination of the internal radius of the orifices that must be employed in order to obtain a desired progressive reduction in pressure for an array configuration with a predetermined number of stages.

For the following calculation procedure region 201 will be referred to as $[A_1]$, region 202 as $[A_2]$ and so forth up to the final stage designated with $[A_n]$. Pressure in region [B] is always lower than the lowest pressure in region $[A_n]$, and in case of sonic conditions (choked flow) established through the pressure exhaust openings at least by a fraction ½. For the parameterization method presented the requirement is that sonic conditions are always established at the exit of each opening (the mean value of the Mach number at the exit of each aperture is always equal to 1.0, which means that a chocked flow is formed). Although the parameterization method disclosed is concerned with the formation of chocked flow conditions at the orifices used for pumping gas it is by no means limited to such. Other parameterization procedures can be devised readily apparent to those skilled in the art, for example different array configurations are envisaged where the flow through the orifices on the insulating rings is not chocked and/or the pumping line [B] is further sub-divided into regions which may be individually connected to one or more pumps, and each region in communication with only a fraction of the skimmer array through the corresponding orifices on the ring spacers.

For chocked flow conditions the internal radius of each of the orifices is computed by defining (a) the mass flow rate $m_i$ that is desired to be subtracted from each region $[A_i]$, i=1, . . . , n, (b) the average static pressure $P_i$ in each region $[A_i]$, i=1, . . . , n, (c) the average total pressure $P_{ti}$ in each region $[A_i]$, i=1, . . . , n, (d) the average total temperature $T_{ti}$ in each region $[A_i]$, i=1, . . . , n, and finally (e) the number of orifices $C_i$ where i=1, . . . , n, distributed circumferentially on each of the ring spacers connecting each region with the pumping line region [B].

The following definitions are introduced for conciseness. Here n refers to the number of the consecutive regions, M is the mach number, R is the gas constant, $\gamma$ is the ratio of specific heats of the gas ($\gamma=C_p/C_v$) where $C_p$ is the heat capacity at constant pressure and $C_v$ is the heat capacity at constant volume. The speed of sound $\alpha_{ci}$, the gas density $\rho_{ci}$ and the average static temperature $T_{ci}$ are determined at the exit of the orifices. $T_{ti}$ is the average total temperature in each region $[A_i]$. The average total pressure at the exit of each orifice is $P_{cti}$ and $P_{ci}$ is the average static pressure for each region $[A_i]$. A coefficient $C_{pl,i}$ to account for the total pressure losses through the orifices is also introduced with a value of 0.99. Finally, the mass flow rate to be subtracted from each region $[A_i]$ is denoted with $m_i$. The number of openings $C_i$ in each region $[A_i]$ have identical geometric characteristics, but may differ to those in other regions.

We then define the function for the Mach number:

$$f(M) = \frac{2}{[(\gamma - 1)M^2 + 2]}$$

For choked flow conditions the value of the Mach number is unity (M=1) and the expression reduces to:

$$f(M) = \frac{2}{[(\gamma - 1) + 2]}$$

Then assuming perfect gas conditions and one-dimensional flow inside each orifice the following computations can be used in each region $[A_i]$. The average total temperature at the exit of the orifice is set equal to the average total temperature $T_{ti}$ of the upstream region $[A_i]$.

The average static temperature $T_i$, the average total pressure $P_{cti}$ and the average static pressure $P_{ci}$ at the exit of each orifice are related respectively as:

$$T_{ci} = T_{ti} f(M) P_{cti} = P_{ti} C_{pti}$$

$$P_{ci} = P_{cti} f(M)^{\frac{\gamma}{\gamma-1}}$$

The average gas density is then calculated using the perfect gas law as follows:

$$\rho_{ci} = \frac{P_{ci}}{RT_{ci}}$$

and the average speed of sound at the exit of each orifice is given by:

$$\alpha_{ci} = \sqrt{\gamma R T_{ci}}$$

The total cross sectional area for all the orifices arranged circumferentially on each of the ring spacers positioned in regions $[A_i]$ is then given by:

$$E_i = \frac{m_i}{\rho_{ci}\alpha_{ci}}$$

It follows that the radius $R_{ci}$ for each of the orifices can be calculated using the following expression:

$$R_{ci} = \sqrt{\frac{E}{C_i \pi}}$$

In the first preferred embodiment discussed using FIG. 18 and the parameterization method presented with reference to FIG. 19 a common axis is shared between the skimmer electrodes. It is also desirable to design an array where skimmers are progressively displaced off-axis to re-direct a greater portion of the gas flow toward the pumping orifices and into the pumping line to reduce the gas load presented to the apertures further downstream. Reducing the gas load to the skimmer apertures allows for reducing the number of skimmers employed and/or allows for a reduced spacing between skimmers and/or increasing the size of the apertures to enhance ion transmission. FIG. 20 shows an illustrative example where the first 301 and second 302 skimmers are arranged with an offset in the radial direction and an increased portion of the gas flow, indicated by arrows 303 is directed toward the pumping line 304. Side-ways subtraction of a proportion of the gas load can also be achieved by shaping the skimmer electrodes appropriately to help channel the gas toward the pumping line.

This effect could alternatively or additionally be achieved by other methods of displacing the gas, for example arranging the skimmers along a curved path, or introducing an inclination between skimmers.

With reference to the off-set design shown in FIG. 20, ions can be maintained near the ion optical axis by compensating electrostatic potentials applied to the skimmer electrodes. Deflection and focusing fields can also be used to counteract the force on the ions due to the gas flow field. Mass discrimination effects in terms of differences in ion mobility may be minimised by ensuring that the aperture displacement is small, of the order of a few mm down a fraction of a millimeter.

FIG. 20 is a schematic illustration of a generalized arrangement of an array designed with off-axis skimmer-electrodes.

Skimmer apertures can be reduced in size progressively to further reduce the gas load at the inlet of the mass spectrometer. In other embodiments aperture sizes are uniform throughout the array or can be increased with distance. The actual aperture sizes can be carefully selected by taking into consideration the dimensions of the orifices on the ring spacers connecting the skimmer array to the pumping line. Here too the final pressure presented at the inlet of the mass spectrometer may range from a fraction of an atmosphere to a few mbar. Also the device can be operated at elevated temperatures to promote desolvation of charged droplets (or prevent re-clustering of previously desolvated ions) produced by electrospray ionization or other types of atmospheric pressure ionization sources.

Auxiliary gas flows can be envisaged to enhance ion transmission, for example a jet of gas introduced coaxially to the electrospray nebulizer gas to direct the entire spray into the apparatus, or a counter gas flow to support redirection of gas flow toward the pumping line. Electrodes additional to the skimmer electrodes are desirable for providing electrostatic focusing and collimation of ions more effectively. FIG. 21 shows the focusing electrode 403 positioned between the first 401 and second 402 skimmers to form an electrostatic lens controlled by adjusting the potential applied. It is also preferable to machine the rear side of the focusing electrodes to form slots extending radially outwards and aligned with the orifices on the ring spacers.

FIG. 21 is a schematic illustration of a generalized arrangement of an array equipped with focusing electrodes to collimate the ions and simultaneously channel the gas flow. Electrode shapes departing from the standard skimmer-based coaxial design described so far may equally be used. For example electrodes can be machined flat or take forms where the coaxial symmetry is broken to include channels for the gas to flow outwardly. The thickness of the electrodes can also be varied substantially to affect conductance. The apertures can also be tapered to shape the gas jets discharging into each of the consecutive regions of the apparatus.

An example of a skimmer shaped electrode machined to form channels to direct the deflected portion of the gas outwardly to the pressure exhaust openings is shown in FIG. 22. The skimmer 101 comprises a circular disk the front face of which bears a frusto-conical projection 530 the top of which presents an ion inlet opening 520 for a given pressure-control chamber, for receiving ions entrained within a flow of gas. Four gas guides (500, 510) are arranged symmetrically radially around the frustum 530. Each gas guide comprises a radial channel formed within the front face and extending generally linearly from a proximal end 500 adjacent to a base part of the frustum, to a distal open end 510 at the peripheral edge of the disk 101. The proximal end of the channel defines gas capture region in which the channel is wider than the distal end. This assists in capturing a greater proportion of gas deflected by the frustum 530. The width of the channel decreases gradually (tapers) along a part of the length of the channel extending away from the gas capture region in the direction towards the distal end such that the width of the channel remains substantially constant towards and at the distal end. The depth of each gas guide is substantially constant along the width and length of the channel. In use, gas deflected by the frustum, which does not pass through the inlet opening 520, is deflected towards a gas capture region 500 of one or more gas guides, where it is channelled along the channel of the gas guide(s) towards a pressure exhaust opening 104. The distal ends of the channels of the gas guides are preferably positioned in register with a respective pressure exhaust opening to permit efficient output of the guided gas.

The discussion included in this Annex is intended to serve as a basic description. Although the present has been described in accordance with the various embodiments shown and discussed in some detail, one of ordinary skill in the art will readily recognize that there could be variations to the embodiments and those variations would be within the scope and spirit of the present invention. The reader should be aware that the specific discussion may not explicitly describe all embodiments possible; many alternatives are implicit. For instance the number of regions the interface apparatus is comprised of, the range of operating pressures, the nature of the electric fields, DC or RF or combinations thereof, including the shape of the electrodes and the design of the pumping line together with the off-set configuration and broken symmetry electrodes can all be combined and varied to a great extent.

The invention claimed is:

1. An ion transfer apparatus for transferring ions from an ion source at an ion source pressure, which ion source pressure is atmospheric pressure, along a path towards a mass analyser at a mass analyser pressure that is lower than the ion source pressure, the apparatus including:

five or more pressure controlled chambers, wherein each pressure controlled chamber in the ion transfer apparatus includes an ion inlet opening for receiving ions from the ion source on the path and an ion outlet opening for outputting the ions on the path;

wherein the pressure controlled chambers are arranged in succession along the path from an initial pressure controlled chamber of the pressure controlled chambers to a final pressure controlled chamber of the pressure controlled chambers, wherein the ion outlet opening of each pressure controlled chamber other than the final pressure controlled chamber is in flow communication with the ion inlet opening of a successive adjacent pressure controlled chamber, of the pressure controlled chambers;

wherein the ion transfer apparatus is configured to have, in use, a plurality of pairs of adjacent pressure controlled chambers of the pressure controlled chambers for which a ratio of pressure in an upstream pressure controlled chamber to pressure in a downstream pressure controlled chamber in each pair is set to be greater than 1 and less than 1.8 such that there is substantially subsonic gas flow in the downstream pressure controlled chamber in each pair;

wherein the ion transfer apparatus is configured to have, in use, a ratio of the ion source pressure to pressure in the initial pressure controlled chamber of 1.8 or less such that there is substantially subsonic gas flow in the initial pressure controlled chamber.

2. An ion transfer apparatus as set out in claim 1, wherein, for the/each pair of adjacent pressure controlled chambers, the ratio of pressure in the upstream pressure controlled chamber to pressure in the downstream pressure controlled chamber is 1.6 or less.

3. An ion transfer apparatus as set out in claim 1, wherein the ion transfer apparatus includes 10 or more pressure controlled chambers.

4. An ion transfer apparatus as set out in claim 1, wherein the ion transfer apparatus is configured to have, in use, a plurality of pairs of adjacent pressure controlled chambers in the ion transfer apparatus for which the downstream pressure controlled chamber is at a pressure above 10000 Pa.

5. An ion transfer apparatus as set out in claim 1, wherein all pairs of adjacent pressure controlled chambers in the ion transfer apparatus for which the downstream pressure controlled chamber is at a pressure above 10000 Pa meet a pressure ratio condition requiring that a ratio of pressure in an upstream pressure controlled chamber to pressure in a downstream pressure controlled chamber is set such that there is substantially subsonic gas flow in the downstream pressure controlled chamber.

6. An ion transfer apparatus as set out in claim 1, wherein all of the pairs of adjacent pressure controlled chambers in the ion transfer apparatus for which the downstream pressure controlled chamber is at a pressure above 10000 Pa are included in the plurality of pairs of adjacent pressure controlled chambers for which a ratio of pressure in an upstream pressure controlled chamber to pressure in a downstream pressure controlled chamber is set to be 1.8 or less.

7. An ion transfer apparatus as set out in claim 1, wherein each pressure controlled chamber in the ion transfer apparatus includes one or more focusing electrodes configured to produce an electric field that acts to focus ions towards the path.

8. An ion transfer apparatus as set out in claim 1, wherein a subset of the pressure controlled chambers each include one or more DC focusing electrodes configured to receive one or more DC voltages so as to produce an electric field that acts to focus ions towards the path, wherein the subset of the pressure controlled chambers each including one or more DC focusing electrodes includes those pressure controlled chambers having a pressure exceeding 4000 Pa.

9. An ion transfer apparatus as set out in claim 1, wherein a subset of the pressure controlled chambers each include one or more RF focusing electrodes, each RF focusing electrode being configured to receive an RF voltage so as to produce an electric field that acts to focus ions towards the path.

10. An ion transfer apparatus as set out in claim 9, wherein the subset of the pressure controlled chambers that each include one or more RF focusing electrodes include those pressure controlled chambers having a pressure below a threshold value.

11. An ion transfer apparatus as set out in claim 1, wherein:

a subset of the pressure controlled chambers each include one or more DC focusing electrodes configured to receive one or more DC voltages so as to produce an electric field that acts to focus ions towards the path;

a subset of the pressure controlled chambers each include one or more RF focusing electrodes, each RF focusing electrode being configured to receive an RF voltage so as to produce an electric field that acts to focus ions towards the path;

pressure controlled chambers having a pressure that exceeds a threshold pressure $P_t$ are included in the subset of pressure controlled chambers that each include one or more DC focusing electrodes;

pressure controlled chambers having a pressure that is below the threshold pressure $P_t$ are included in the subset of pressure controlled chambers that each include one or more RF focusing electrodes;

the threshold pressure $P_t$ is in the range $3*10^3$ Pa to $0.25*10^3$.

12. An ion transfer apparatus as set out in claim 1, wherein at least one pressure controlled chamber in the ion transfer apparatus in which DC focusing is employed includes one or more ion defocusing regions in which ions are not focused towards the path.

13. An ion transfer apparatus as set out in claim 1, wherein the ion transfer apparatus is for transferring ions from the ion source at the ion source pressure along a plurality of paths towards the mass analyser that is at the mass analyser pressure, wherein each pressure controlled chamber comprises a respective ion inlet opening for receiving ions from the ion source on each path and a respective ion outlet opening for outputting ions on each path.

14. An ion transfer apparatus as set out in claim 13, wherein the plurality of ion outlet openings of each pressure controlled chamber are arranged along a circumferential path.

15. An ion transfer apparatus as set out in claim 1, wherein:

the ion transfer apparatus includes a first pressure controlled chamber at a first pressure, which first pressure is lower than 10000 Pa, and an adjacent second pressure controlled chamber at a second pressure that is lower than the first pressure, wherein the ion outlet opening of the first pressure controlled chamber is in flow communication with the ion inlet opening of a the second pressure controlled chamber;

the ion transfer apparatus includes an RF focusing device configured to focus ions towards the path, the RF focusing device including a plurality of RF focusing electrodes, wherein each RF focusing electrode of the RF focusing device is configured to receive an RF voltage so as to produce an electric field that acts to focus ions towards the path, wherein each RF focusing electrode of the RF focusing device has a shape that extends circumferentially around the path;

the first and second pressure controlled chambers include RF focusing electrodes of the RF focusing device.

16. An ion transfer apparatus as set out in claim 15, wherein each RF focusing electrode of the RF focusing device has a thickness in the direction of the path and a thickness in a direction radial to the path that is less than a distance separating the RF focusing electrode from an adjacent RF focusing electrode of the RF focusing device.

17. An ion transfer apparatus as set out in claim 1, wherein the ion transfer apparatus includes one or more gas pumps configured to pump gas out from pressure controlled chambers in the ion transfer apparatus such that, in use, the ion transfer apparatus has at least one pair of adjacent pressure controlled chambers for which a predetermined ratio of pressure in an upstream pressure controlled chamber to pressure in a downstream pressure controlled chamber is set.

18. A mass spectrometer including:

an ion source at an ion source pressure;

a mass analyser at a mass analyser pressure;

an ion transfer apparatus configured to transfer ions from the ion source at theme ion source pressure which is atmospheric pressure, along a path towards the mass analyser at theft mass analyser pressure that is lower than the ion source pressure, the ion transfer apparatus including:

five or more pressure controlled chambers, wherein each pressure controlled chamber in the ion transfer apparatus includes an ion inlet opening for receiving ions from the ion source on the path and an ion outlet opening for outputting the ions on the path;

wherein the pressure controlled chambers are arranged in succession along the path from an initial pressure controlled chamber of the pressure controlled chambers to a final pressure controlled chamber of the pressure controlled chambers, wherein the ion outlet opening of each pressure controlled chamber other than the final pressure controlled chamber is in flow communication with the ion inlet opening of a successive adjacent pressure controlled chamber of the pressure controlled chambers;

wherein the ion transfer apparatus is configured to have, in use, a plurality of pairs of adjacent pressure controlled chambers of the pressure controlled chambers for which a ratio of pressure in an upstream pressure controlled chamber to pressure in a downstream pressure controlled chamber in each pair is set to be greater than 1 and less than 1.8 such that there is substantially subsonic gas flow in the downstream pressure controlled chamber in each pair;

wherein the ion transfer apparatus is configured to have, in use, a ratio of the ion source pressure to pressure in the initial pressure controlled chamber of 1.8 or less such that there is substantially subsonic gas flow in the initial pressure controlled chamber.

* * * * *